US011110030B2

(12) United States Patent
Le et al.

(10) Patent No.: US 11,110,030 B2
(45) **Date of Patent: *Sep. 7, 2021**

(54) METHOD OF BODY SCANNING DETECTION FOR ADVANCED ROBOTIC MASSAGE CHAIRS

(71) Applicant: LURACO, INC., Arlington, TX (US)

(72) Inventors: Kevin Le, Richland Hills, TX (US); Thanh Le, Arlington, TX (US); Matthew Palmore, Grand Prairie, TX (US)

(73) Assignee: Luraco, Inc, Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/099,232

(22) Filed: Nov. 16, 2020

(65) Prior Publication Data

US 2021/0059895 A1 Mar. 4, 2021

Related U.S. Application Data

(60) Division of application No. 16/854,491, filed on Apr. 21, 2020, now Pat. No. 10,905,624, which is a (Continued)

(51) Int. Cl.
*A61H 15/00* (2006.01)
*A47C 7/62* (2006.01)
(Continued)

(52) U.S. Cl.
CPC ..... *A61H 15/0078* (2013.01); *A47C 7/72* (2013.01); *A47C 31/126* (2013.01);
(Continued)

(58) Field of Classification Search
CPC ..... A61H 9/0078; A61H 15/0078; A61H 2015/0014; A61H 2201/0103;
(Continued)

(56) References Cited

U.S. PATENT DOCUMENTS 4,408,800 A * 10/1983 Knapp ..... A47C 1/0244 297/301.2
5,265,590 A * 11/1993 Takagi ..... A61H 15/0078 601/52
(Continued)

*Primary Examiner* — Timothy A Stanis
(74) *Attorney, Agent, or Firm* — Law Office of Jeff Williams PLLC; J. Oliver Williams

(57) ABSTRACT

A massage chair includes a back massage system and a thigh massage system with a roller mechanism configured to move a roller in a three dimensional orbital motion. The roller mechanism is driven by a single motor that can change the direction in operation. Also included is a roller motion drive element within the roller mechanism. A shaft is configured to pass through the roller motion drive element in an offset non-perpendicular angle relative to the end face thereby forming an angle between the shaft and the end face that is less than 85 degrees. The offset causes the orbital motion of the roller when rotated. The electronics of the massage chair facilitate facial recognition and a medical assessment device to detect bodily characteristics. The backrest of the massage chair can elongate to stretch the user. A plurality of airbags are also available for the twisting of the user.

30 Claims, 21 Drawing Sheets

Related U.S. Application Data continuation-in-part of application No. 16/290,748, filed on Mar. 1, 2019, now Pat. No. 10,849,819, which is a continuation-in-part of application No. 14/103,840, filed on Dec. 11, 2013, now abandoned.

(51) Int. Cl.
*A47C 7/72* (2006.01)
*A47C 31/12* (2006.01)
*A61H 9/00* (2006.01)

(52) U.S. Cl.
CPC ... *A61H 9/0078* (2013.01); *A61H 2015/0014* (2013.01); *A61H 2201/0103* (2013.01); *A61H 2201/1207* (2013.01); *A61H 2201/1454* (2013.01); *A61H 2201/1673* (2013.01); *A61H 2201/5012* (2013.01); *A61H 2201/5043* (2013.01); *A61H 2201/5092* (2013.01); *A61H 2203/0431* (2013.01); *A61H 2205/04* (2013.01); *A61H 2205/081* (2013.01); *A61H 2205/108* (2013.01); *A61H 2230/065* (2013.01); *A61H 2230/201* (2013.01); *A61H 2230/203* (2013.01); *A61H 2230/305* (2013.01); *A61H 2230/505* (2013.01); *A61H 2230/855* (2013.01)

(58) Field of Classification Search
CPC .... A61H 2201/1207; A61H 2201/1434; A61H 2201/1673; A61H 2201/5012; A61H 2201/5043; A61H 2201/5092; A61H 2203/0431; A61H 2230/065; A61H 2230/201; A61H 2230/203; A61H 2230/305; A61H 2230/505; A61H 2230/855; A47C 7/72; A47C 31/126
See application file for complete search history.

(56) References Cited

U.S. PATENT DOCUMENTS

| | | | | |
|---|---|---|---|---|
| 6,224,563 | B1 * | 5/2001 | Nonoue | A61H 15/0078 601/99 |
| 6,832,991 | B1 * | 12/2004 | Inada | A61H 39/04 601/100 |
| 2002/0082534 | A1 * | 6/2002 | Jikiba | G01D 5/2013 601/99 |
| 2004/0171972 | A1 * | 9/2004 | Shimizu | A61H 15/00 601/99 |
| 2007/0060851 | A1 * | 3/2007 | Ferber | A61H 7/004 601/99 |
| 2013/0110007 | A1 * | 5/2013 | Jeon | A61B 5/4566 600/594 |
| 2014/0277300 | A1 * | 9/2014 | Lee | A61H 15/0078 607/96 |

* cited by examiner

METHOD OF BODY SCANNING DETECTION FOR ADVANCED ROBOTIC MASSAGE CHAIRS

CROSS REFERENCE TO RELATED APPLICATIONS

This application claims the benefit of and is a Divisional of U.S. patent application Ser. No. 16/854,491, filed 21 Apr. 2020, which is a Continuation-In-Part of U.S. patent application Ser. No. 16/290,748, filed 1 Mar. 2019, which is also a Continuation-In-Part of U.S. patent application Ser. No. 14/103,840, filed 11 Dec. 2013, the contents of which are incorporated by reference herein in its entirety.

BACKGROUND OF THE INVENTION

1. Field of the Invention

The present invention generally relates to massage chairs and massage devices and apparatuses for massage chairs. More specifically, the present invention is directed to a massage chair that provides massage benefits and a stretching effect upon a user through the selective use of a plurality of airbags and frame positioning.

2. Description of Related Art

Massage chairs and massage devices and apparatuses for massage chairs are known in the art.

Most or all of the patents, published patent applications, and/or nonpatent publications directed at massage chairs and massage devices and apparatuses for massage chairs disclose massage benefits or effects being provided to a back body area of a user. At least one discloses massage benefits or effects being provided from the neck to the shoulder, back, and hips.

The present invention overcomes one or more of the shortcomings of the above described massage chairs and massage devices and apparatuses for massage chairs. The Applicant is unaware of inventions or patents, taken either singly or in combination, which are seen to describe the present invention as claimed.

Although strides have been made to massage chairs, shortcomings remain.

BRIEF SUMMARY OF THE INVENTION

The present invention is directed to a massage chair including a back and thigh massage system with at least a pair of rollers that can move in a three-dimensional motion and are driven by a single motor that can change the direction in operation. The massage chair is configured to permit body stretching of a user through the use of an internal actuator configured to extend along the back area of the user. The user is selectively compressed in the chair through one or more airbags to allow the actuation of the actuator to transfer to the user.

A foot massage airbag system includes a plurality of airbags coupled to the extendable footrest frame. An electronic circuit board has an embedded software program for regulating the position of the backrest frame and the footrest frame. Additionally, the electronic circuit board communicates with a compressor and valve to regulate operation of the airbags. Operation of the airbags and actuators at particular sequence and time induce a stretching effect upon a user as the airbags inflate to compress against the user and the extendable footrest frame extends. Another object of the present application is to facilitate selective control of the plurality of airbags such that the airbags may operate simultaneously and/or in an alternating manner.

The airbags may be seen to induce further the stretching and body twisting effect upon one or more portions of a user's body, including the lower and upper appendages and core torso. The airbags may be located on the backrest frame, a seat portion, and the footrest frame.

Another object of the present application is to provide a three-dimensional roller mechanism driven by a single motor wherein rotation of the roller shaft induces an three-dimensional orbital motion in one or more rollers. The roller shaft is off center and non perpendicular to a plane of the ball bearing roller arm sidewall, or in other words, the axis is offset along a non-perpendicular angle such that rotation of the roller shaft induces a wobble or orbital motion.

Another object of the present application is to provide a neck massage and pillow mechanism that is a simplified version of above system in [0010] and includes one or more sensors configured to regulate a minimum and maximum width operation in a plurality of rollers. Additionally, an air cell is used to create a compressive force to areas around the shoulder of a user.

Other objects of the present application include massage chair diagnostic systems to compile data to send to manufacturers for trouble shooting and service of the massage chair. Furthermore, the massage chair may include a remote with a camera that is configured for visual or facial recognition of the user. The facial recognition allows for the massage chair to correctly assign and bring up user profiles particular to the user.

The massage chair may include integrated smart medical systems to carry out a body assessment of the user. The body assessment may include measurement of blood pressure, heart rate, body temperature and so forth. The may be done through a finger tip sensor or other surface skin device. Additional windows or capabilities may be the measurement of blood sugar, stretch and oxygen levels of the user. Such data would be displayable on the remote with a screen.

To better enhance the massage effect for the user, the massage chair may also include a virtual reality headset configured to provide a viewing and audible effect for the user. Data is transferred between the headset and the massage chair electronic system for regulation of the experience.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
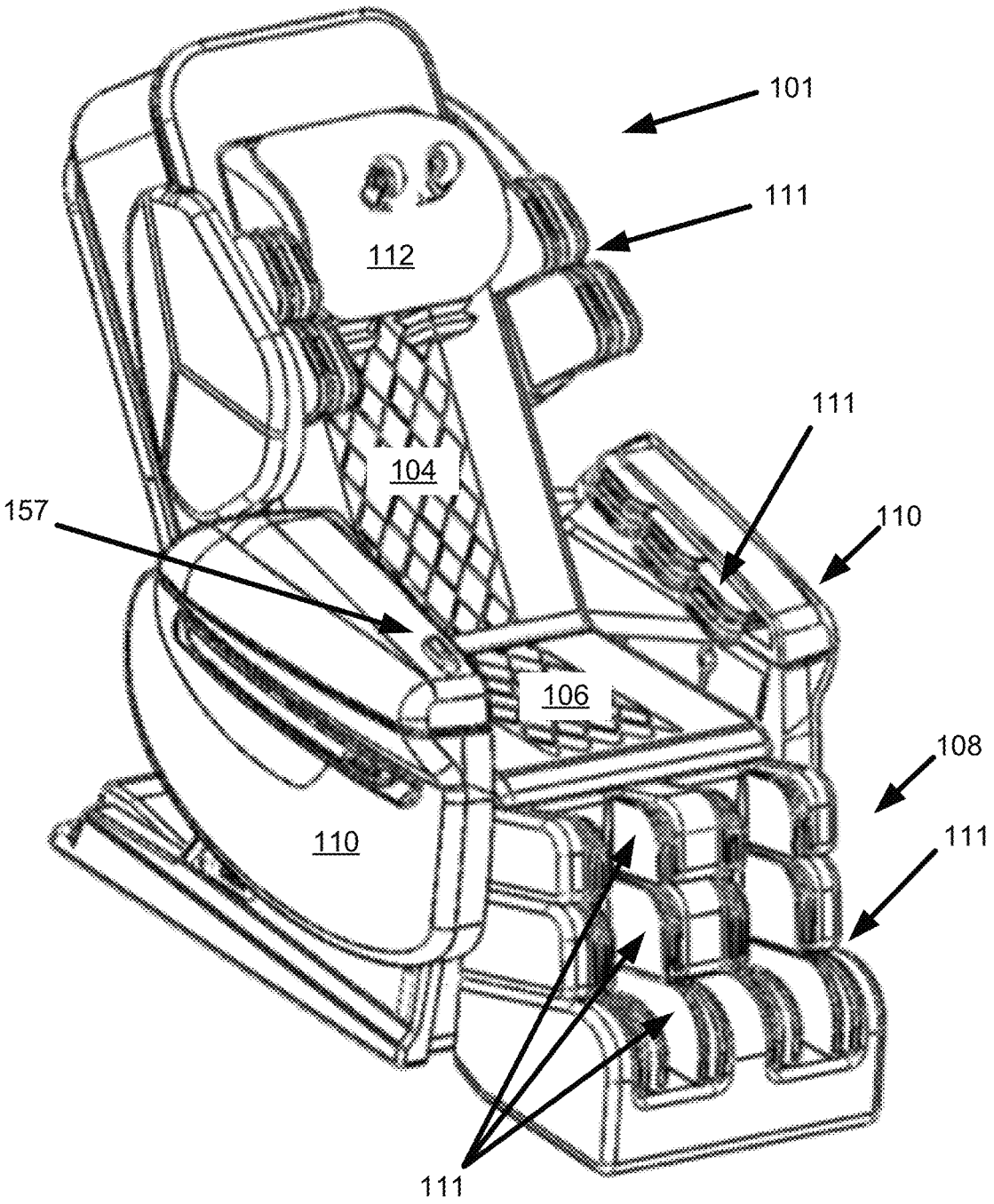
FIG. 1 is a perspective view of a massage chair according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Figure 2:
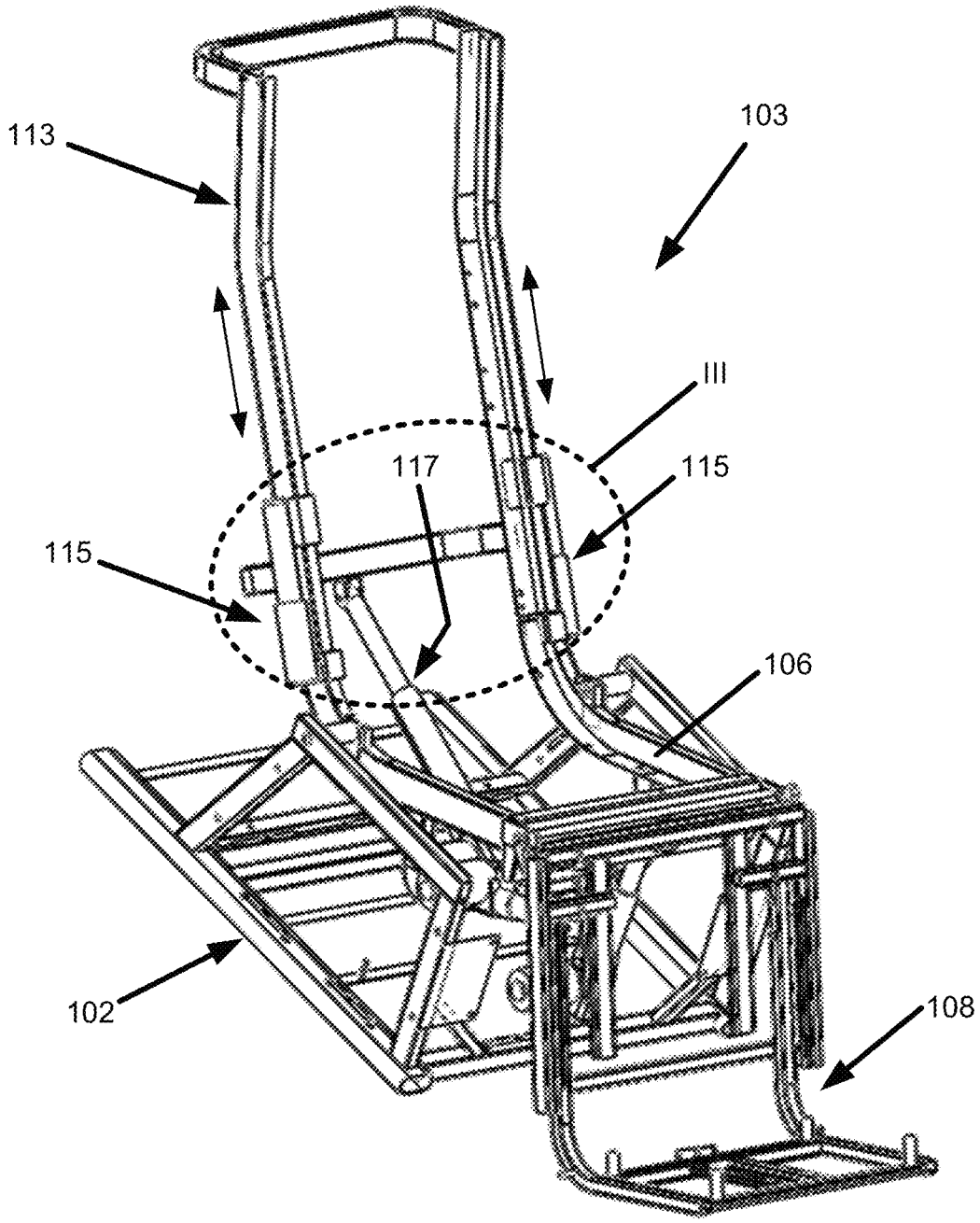
FIG. 2 is a perspective view of a frame for the massage chair of FIG. 1.

Referring now to FIGS. 1 and 2 in the drawings, a massage chair 101 is illustrated. Massage chair 101 is configured to induce a stretching effect upon a user's body during a massage. Chair 101 includes a frame 103 (see FIG. 2) along with a backrest 104, seat portion 106, lower leg portion 108, arm rests 110, and a head rest 112. Chair 101 includes a back massage system 105 and a thigh massage system 107 incorporating at least one of a roller mechanism 109 and an airbag 111. The back massage system includes a sliding mechanism 113 for the purpose of inducing a stretching effect upon the user. The airbags 111 used in chair 101 are useful to assist in a twisting effect on the user by selectively regulating performance of individual airbags relative to another airbag. The various functions and features of chair 101 will be described an shown in the figures and description below.

In particular with FIG. 2 in the drawings, a chair frame for chair 101 is illustrated. Frame 103 includes structural supports for backrest 104, seat portion 106, and lower leg portion 108. Additional supports structure for the other parts of frame 103 have been removed for clarity purposes. In the backrest portion of frame 103, rails 113 are located on each side of frame 103 and support roller mechanism 109 (see FIG. 11) as it translates along backrest 104 and/or seat portion 106. Sliding or extendable mechanism 115 is configured to selectively translate rails 113 linearly so as to elongate and retract backrest 104. Sliding or extendable mechanism 115 is operated through actuator 117 to induce the stretching effect on a user's back and body. Also of note in FIG. 2 is a base 102 of frame 103. Base 102 supports and locates backrest 104, seat portion 106, and lower leg portion 108.

Figure 3:
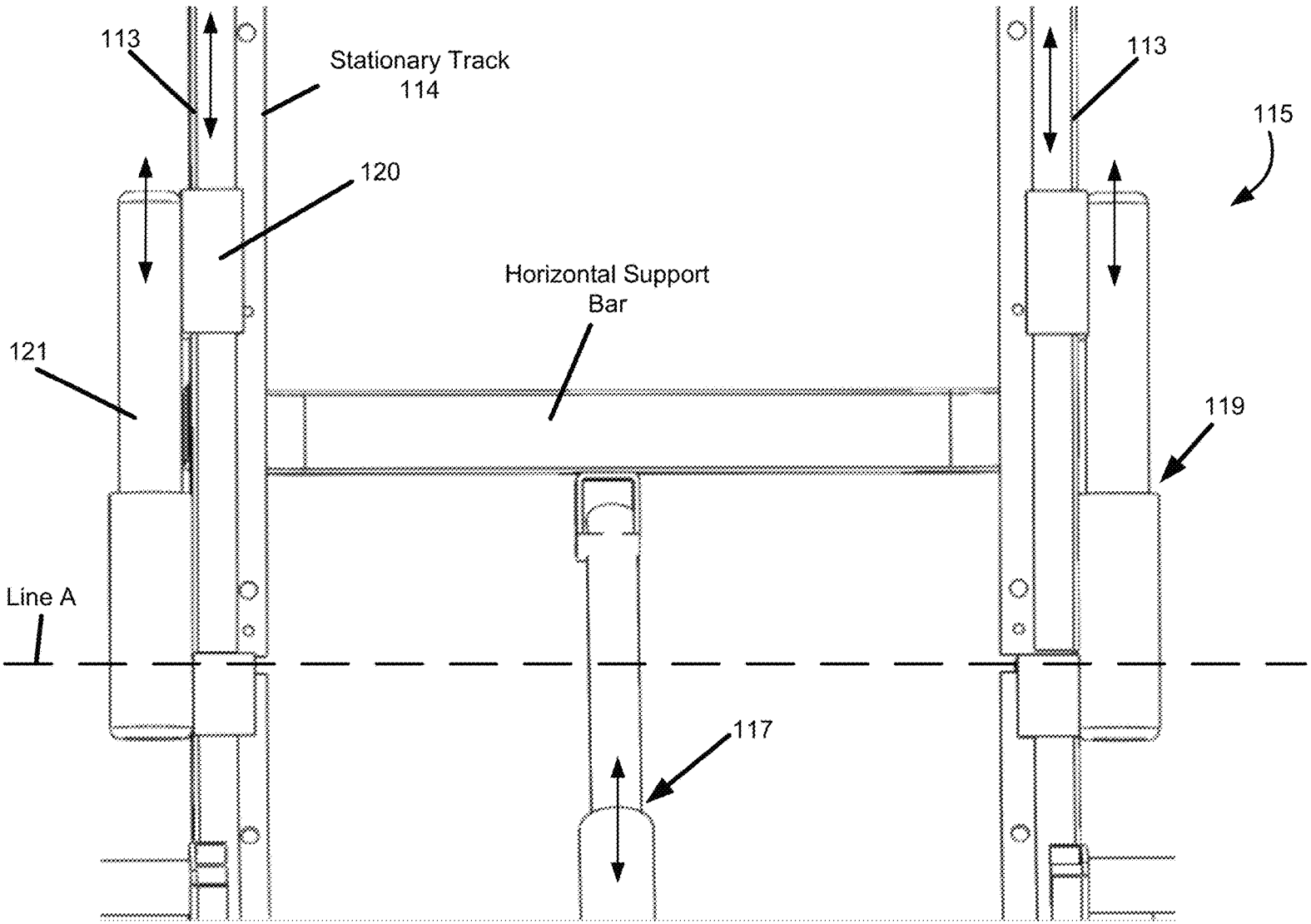
FIG. 3 is an enlarged view of a sliding mechanism using an actuator in the frame of FIG. 2.

Referring now also to FIG. 3 in the drawings, an enlarged view of Sliding or extendable mechanism 115 is illustrated. Backrest frame 104 can extend and retract during operation by at least a Sliding or extendable mechanism 115 or an extension device attached to the chair frame 103 and that is powered by an actuator 117. The bottom section of the frame is stationary. The upper section, rails 113, can extend and retract by a bidirectional actuator 117. This motion provides the user with a spinal decompression for therapeutic treatment.

Sliding or extendable mechanism 115 includes a slider assembly 119 having a slider 121 and a coupler 120. The coupler 120 is coupled to rails 113. Frame 103 has a track 114 that is stationary within backrest 104. Rails 113 are configured to selectively translate along track 114 in a linear manner. It is understood that sliding tubes or rollers may be used to facilitate the translating motion of rails 113 with respect to the stationary track. Sliding or extendable mechanism 115 may be either located wholly within backrest 104 or may extend into a portion of seat portion 106. Line A in FIG. 3 acts as an exemplary division between backrest 104 and seat portion 106.

Further included in Sliding or extendable mechanism 115 is actuator 117. Actuator 117 is located between rails 113 and engages a horizontal support bar at a first end and base 102 at a second end. Actuator 117 is selectively operated to elongate and or retract in length. This adjustment in length pushes or pulls on rails 113, thereby extending and retracting backrest 104. It is understood that many types of structural embodiments may be developed to facilitate the linear translation of backrest 104 and that the method depicted is only one such method. Actuator 117 may be located between any other portions of frame 103 as long as one portion is in communication with rails 113.

It should be understood that sliders 121 within slider assembly 119 are anchored to a stationary point in frame 103, such as the stationary track and/or seat portion 106 for example.

Figure 4:
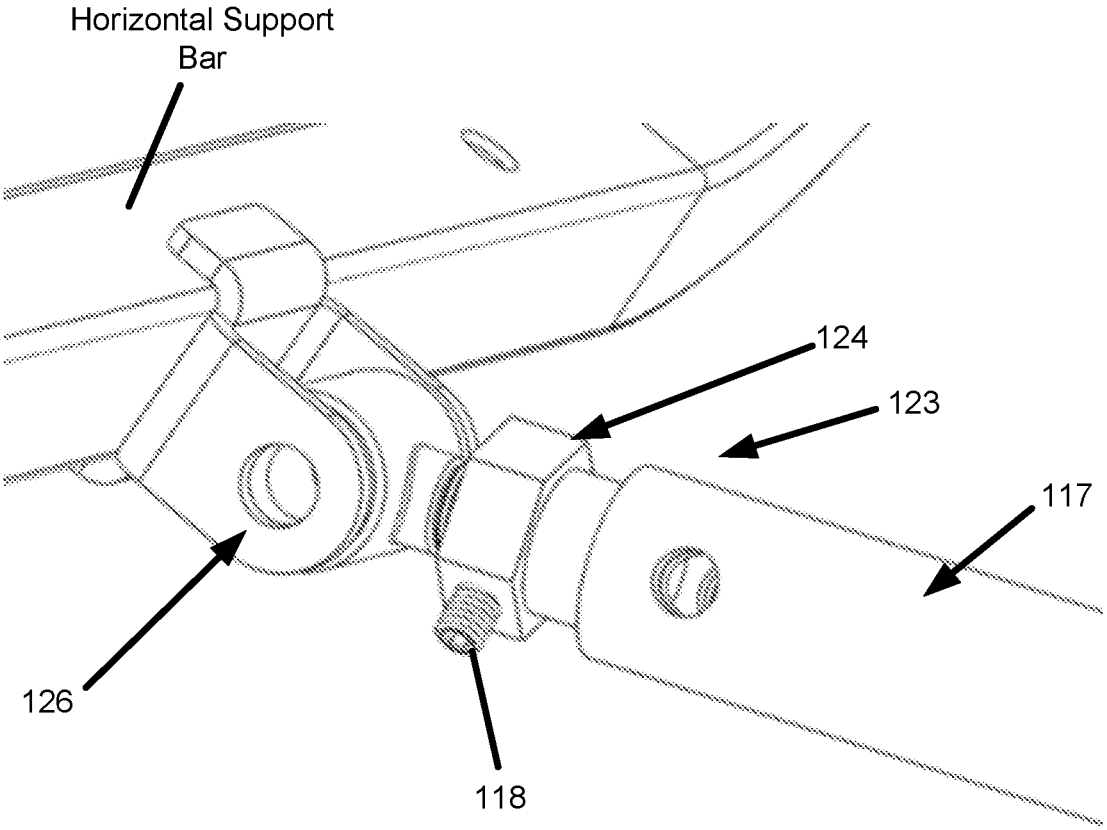
FIG. 4 is an enlarged perspective view of a length adjustment device in the frame of FIG. 2.

Referring now also to FIG. 4 in the drawings, an enlarged perspective view of length adjustment device 123 is illustrated. Optionally included in Sliding or extendable mechanism 115 is a length adjustment device 123. In another aspect of this embodiment, the length of actuator 117 can be adjusted to accommodate different user's heights. As actuator 117 has a limited amount of travel, it is useful to be able to adjust the length of actuator 117 when at rest. Furthermore, length adjustment device 123 can be used to calibrate actuator 117. Calibration is needed to compensate for manufacturing errors or tolerances. So that two sides of the frame can match up precisely after retraction. This is crucial for the roller mechanism 109 to travel across the joint (at line A) without any issues or noise. Actuator length is adjusted by rotating the nut 124 and is locked by a set screw 118. Set screw 118 is used to prevent rotation after adjustment with nut 124 has been made. Device 123 is coupled to a frame hinge 126 in communication with the horizontal support bar.

Figure 5:
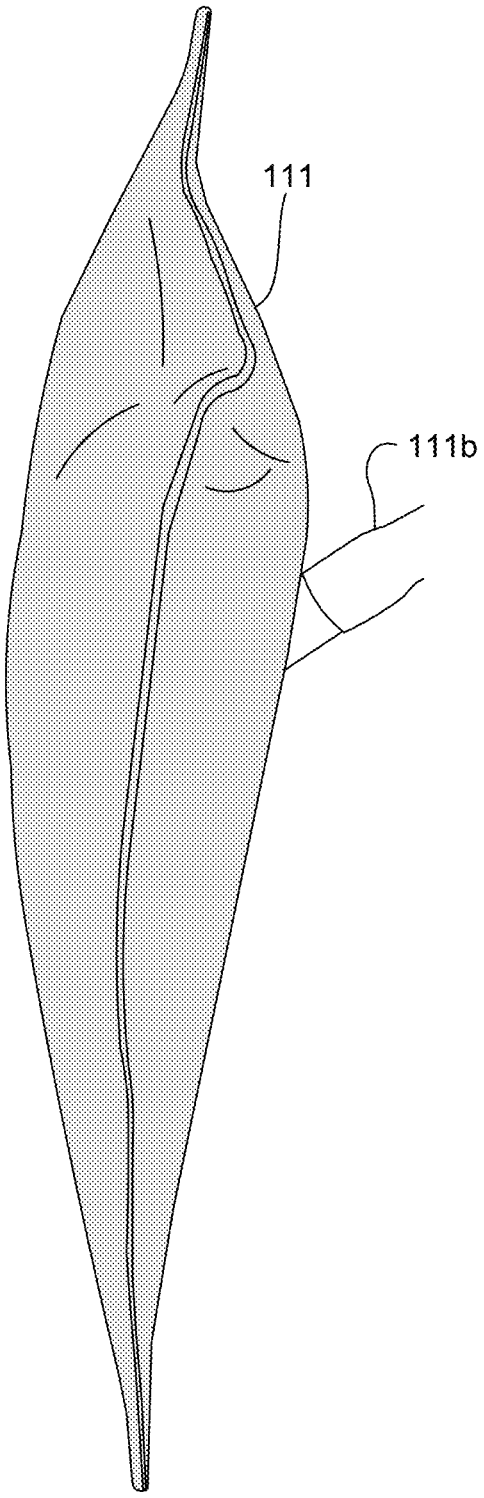
FIGS. 5 and 6 are views of an airbag used in the massage chair of FIG. 1.
Figure 6:
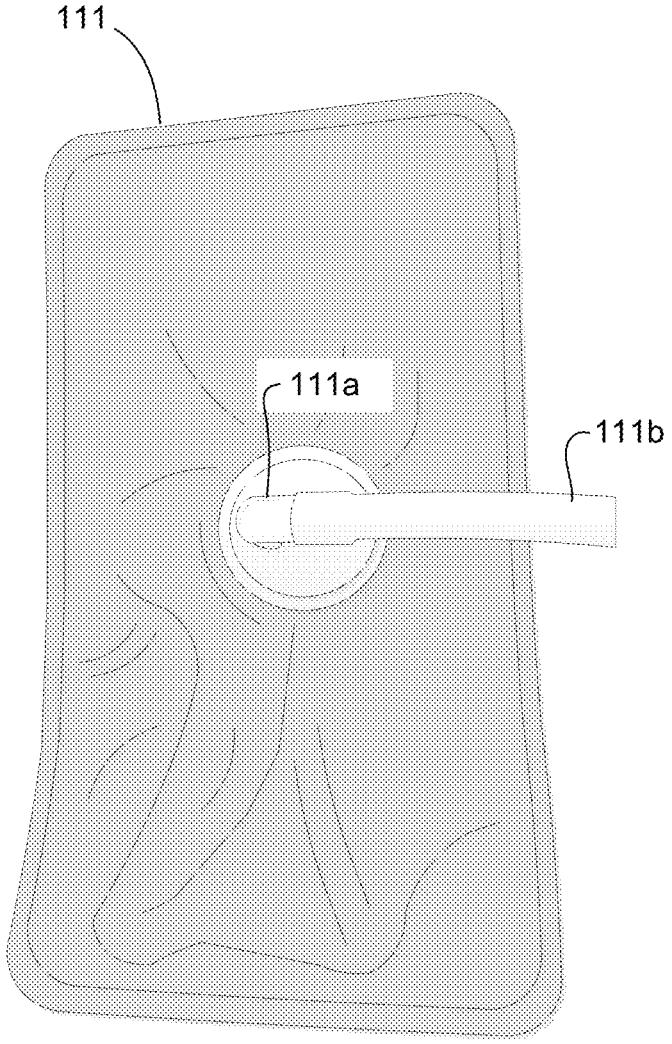

Referring now also to FIGS. 5 and 6 in the drawings, adjustable airbags 111 used in combination with the massage chair 101 is illustrated. As seen in FIGS. 5-6, airbags 111 (air-cells) are inflatable members configured to hold a selected pressure of air. The air is captured between at least two layers of material. Each airbag 111 is configured to have at least one port 111*a* to permit the introduction and release of air into the airbag 111. Air is delivered via a line 111*b* in communication with the port 111*a*. It is understood that the airbags 111 are not limited to a particular material or number of internal chambers. A single chamber may exist or a plurality of internal chambers. The airbags 111 are configured to assist in the performance of massages by the massage chair 101.

Figure 7:
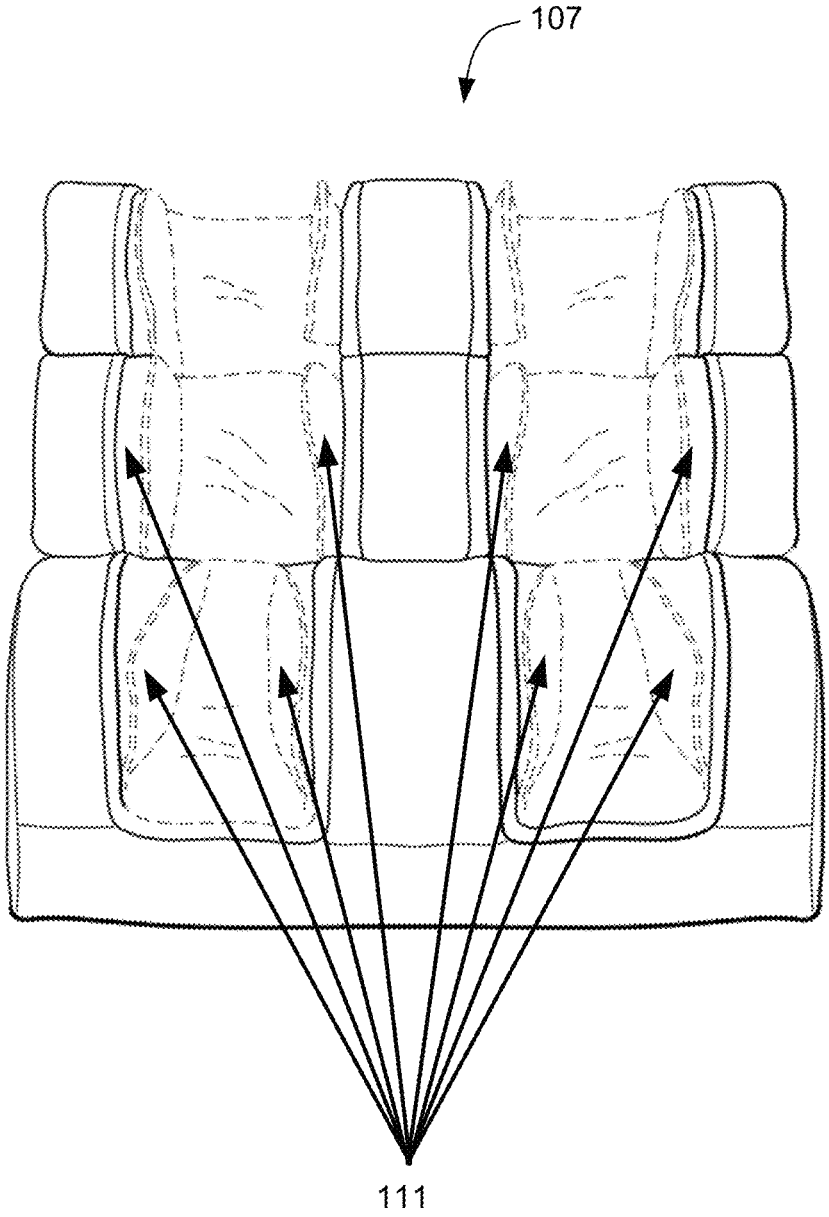
FIG. 7 is a front view of a portion of the massage chair of FIG. 1 with the airbags of FIGS. 5 and 6.

As seen in FIGS. 1 and 7, the airbags 111 are dispersed about the massage chair 101. In particular to FIG. 7, depicted locations for airbags 111 are shown in lower leg portion 108. Each airbag 111 may be located externally or internally within the massage chair 101. FIG. 7 shows a front view of lower leg portion 108. During operation, airbags 111 may inflate in an alternating manner so as to push a user's feet side to side (left and right) thereby creating a swinging motion of the feet over foot rollers in communication with frame 103 in leg portion 108. It is understood that one or more airbags 111 may be located at each notated position in FIG. 7. It is further understood that airbags 340 may at least be located other locations within chair 101, as seen in FIG. 1.

Referring back to FIG. 1 in the drawings, massage chair 101 may include airbags 111 in armrests 110, lower leg portion 108, and backrest 104. The locations of airbags 111 may be used to apply varying degrees of pressure to a user through out different portions of the user's body. It is understood that the airbags 111 may inflate and deflate simultaneously or in an alternating manner. The act of inflating and deflating may be independently regulated and performed in a sequential manner from other airbags 111 within massage chair 101.

Figures 8, 9:
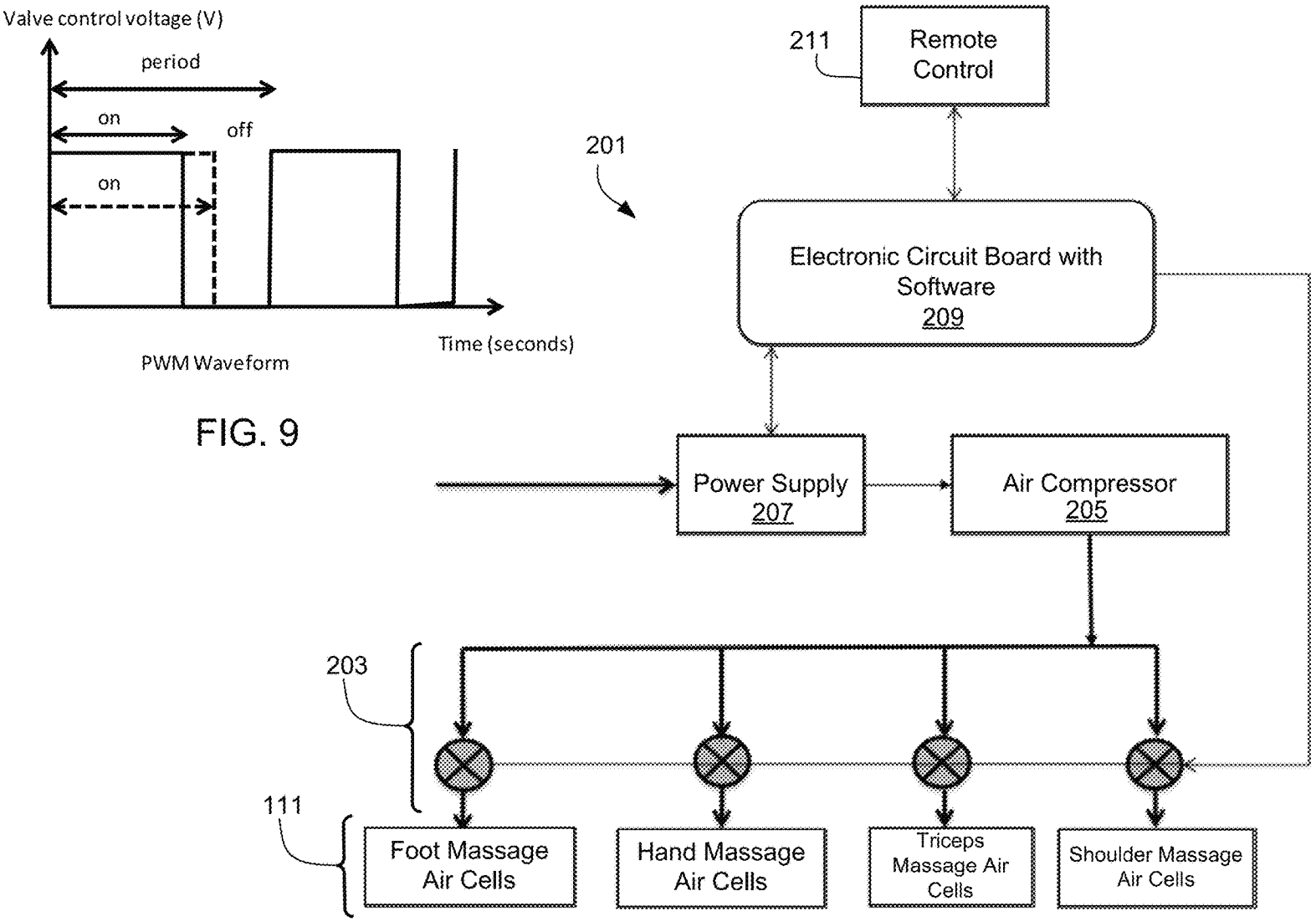
FIG. 8 is a flow chart of an air system used with the massage chair of FIG. 1.
FIG. 9 is an airbag control block diagram depicting how the airbags of FIGS. 5 and 6 are regulated.

Referring now also to FIG. 8 in the drawings, a flow chart of an air system 201 used in the massage chair 101 is illustrated. System 201 includes valves 203, an air compressor 205, a power supply 207, an electronic circuit board 209, and an optional remote control 211. System 201 regulates the selective filling and draining of air within each airbag 111.

Airbags 111 are configured to be selectively filled and drained of air in an effort to effectuate a massage or treatment to the physical body of the user. Each airbag 111 is coupled in fluid communication to a bank of valves 203, wherein one or more valves are used to regulate the air pressure within the one or more airbags 111. Each valve in the bank of valves 203 is in fluid communication with air compressor 205. Board 209 is configured to regulate operation of valves 203 via electrical current to facilitate the passage of air through valves 203. Board 209 also regulates or controls the motors used with the frames and massagers of chair 101. Power supply 207 provides power. Remote control 211 is configured to provide a user interface to the control of system 201. Remote control 211 may be incorporated into a remote control device (see FIG. 27) or be a stand-alone device.

Referring now to FIG. 9 in the drawings, an airbag control block diagram is illustrated depicting how airbags 111 pressures or massage pressures are regulated. Air pressure may be controlled in different manners. One such manner is where air pressure is control by PWM (Pulse Width Modulation). By varying the ratio of valve control, on-time over the off-time, affects air cell pressure held at any one point in time within the airbags 111. Increasing the ratio (on-time over the off-time) corresponds to increase the pressure in the air cells.

Figure 10:
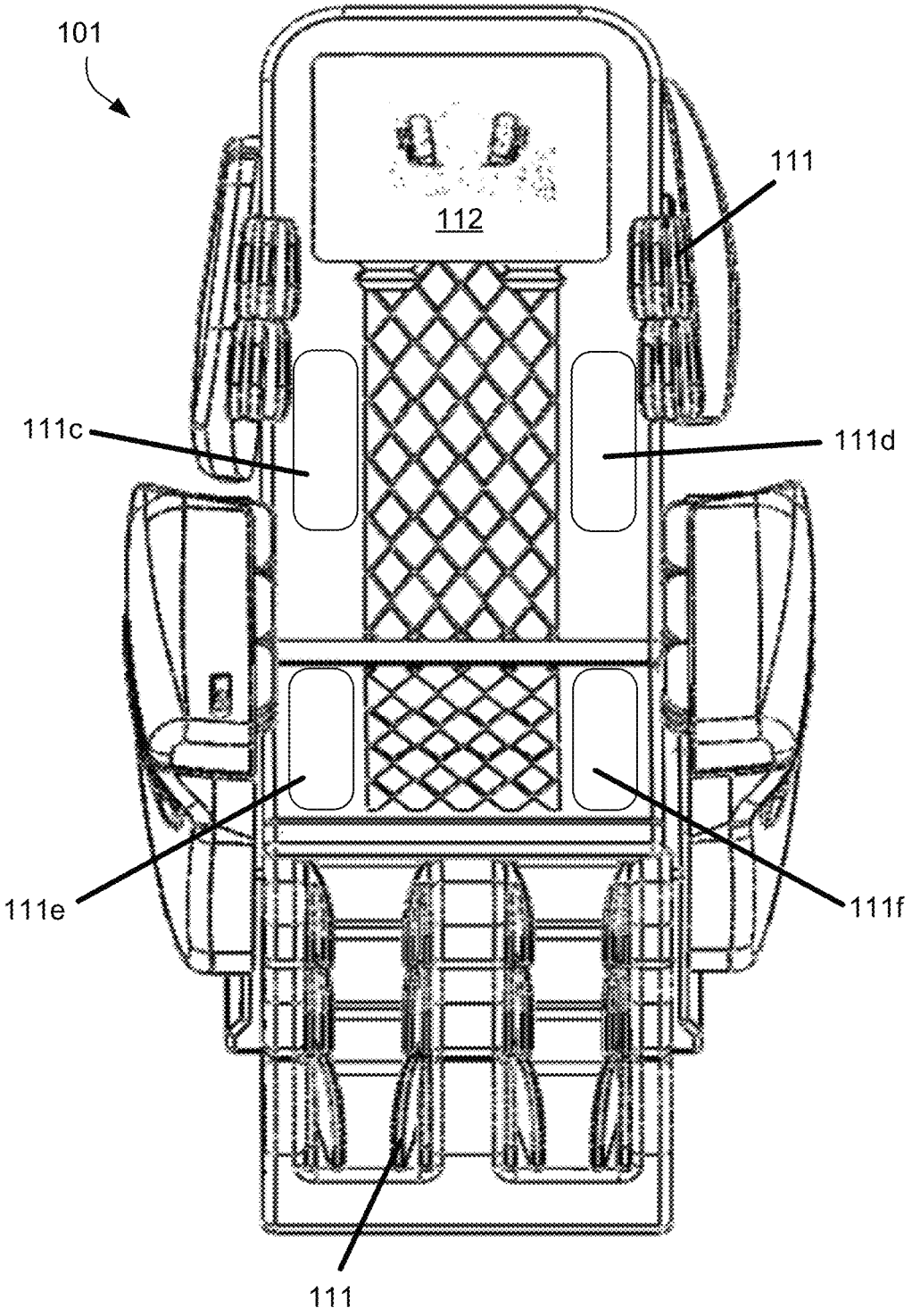
FIG. 10 is a front view of the massage chair of FIG. 1.

Referring now also to FIG. 10 in the drawings, a front view of massage chair 101 is illustrated. In this view, airbags 111*c*-111*f* are shown in backrest 104 and in seat portion 106. These airbags 111*c*-111*f* are generally planer with the seat and backrest as opposed to the other airbags which act on the shoulders, forearms, and lower legs of a user. These airbags are configured to induce a body stretching and twisting effect upon the user by either independently or collectively inflating and deflating at selected times. This method comprises at least four air bags controlled by inline air valves. Airbags 111*c* and 111*d* are located approximately near the lower back area of user. Airbags 111*e* and 111*f* are located approximately at the seat area of user. It is understood that more or less airbags may be used. The body twisting effect is induced by turning on the 111*c* and 111*f* airbags at the same time while 111*d* and 111*e* airbags are off. Then, 111*d* and 111*e* airbags are turned on while 111*c* and 111*f* airbags are turned off. The enhanced lower back stretching effect is induced by turning on the 111*c* and 111*d* airbags while the chair is reclined. The enhanced thigh and leg stretching effect can be added by turning on 111*e* and 111*f* airbags while the footrest is extended and pulled down.

As stated previously, different methods of operation may exist to induce a body twisting effect during a massage on the user. Examples may include the following: During back stretching, inflating airbags 111*c*-111*d* will increase the stretching effect at lower back. During foot and leg stretching, inflating airbags 111*e*-111*f* will increase the intensity of foot and leg stretching effect. A body twisting stretch is induced by Inflating a first diagonal pair air bags (For example: airbags 111*c* and 111*f*) followed by a release of the air; subsequently then inflating the second diagonal pair of airbags 111*d* and 111*e* then releasing the air. The intensity of induced stretching can be controlled by the air valves discussed in FIG. 8.

Figure 11:
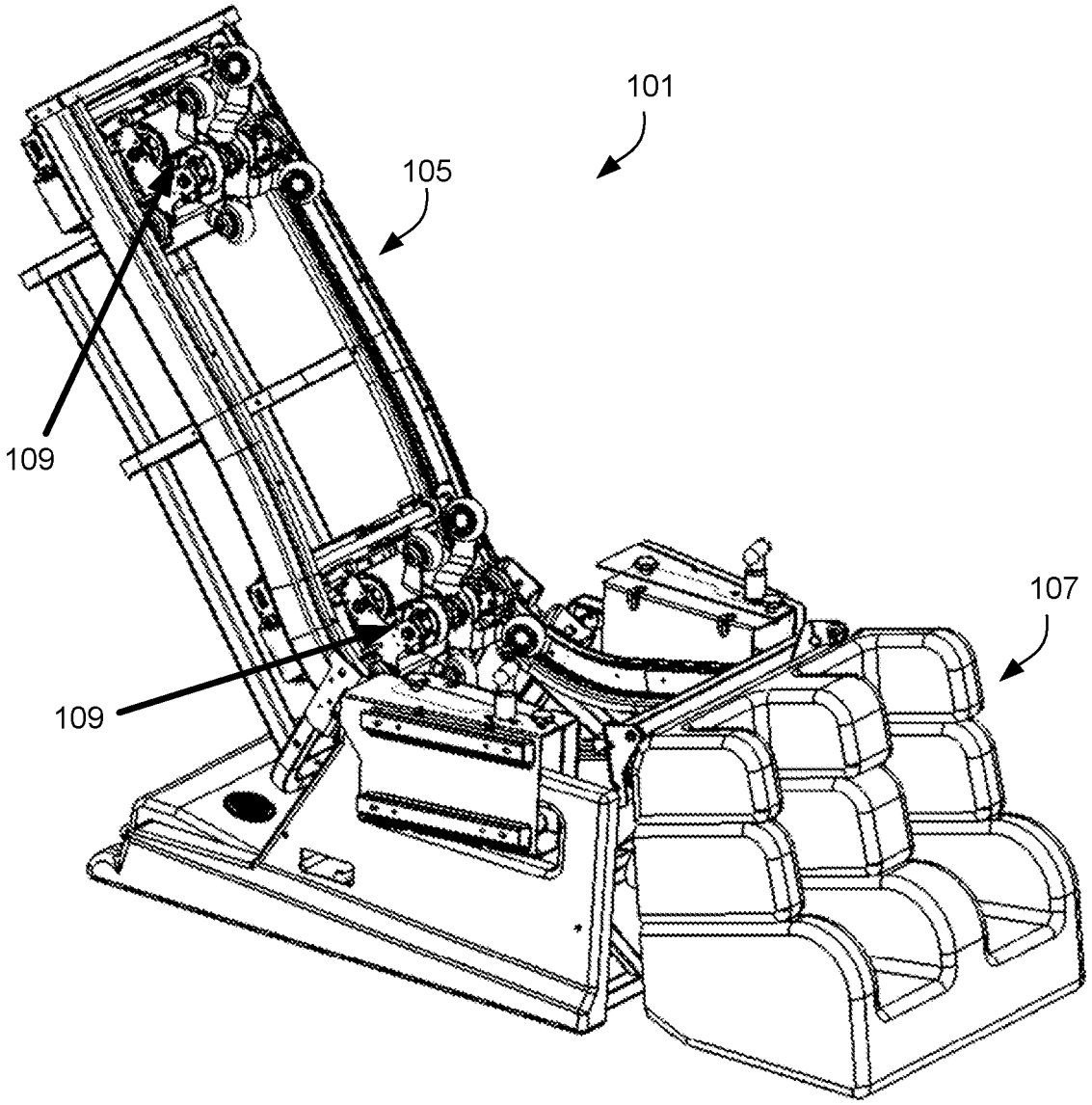
FIG. 11 is a perspective view of the massage chair of FIG. 1 with some components removed to show a roller mechanism.

Referring now also to FIG. 11 in the drawings, a perspective view of massage chair 101 is illustrated wherein the foot massage system 107 is shown along with roller mechanisms 109. Other components of chair 101 are removed for clarity. Massage chair 101 is configured to operate with one or more roller mechanisms 109. As seen in FIG. 11, chair 101 includes double mechanisms 109 to provide double massage effects for the same cycle. One mechanism 109 is located with the backrest 104 and the other is locate to operate with seat portion 106. Each mechanism 109 includes compresses motors and sensors that communicates with a controller to control the massage motion and mechanism travel and to avoid collision.

Figure 12:
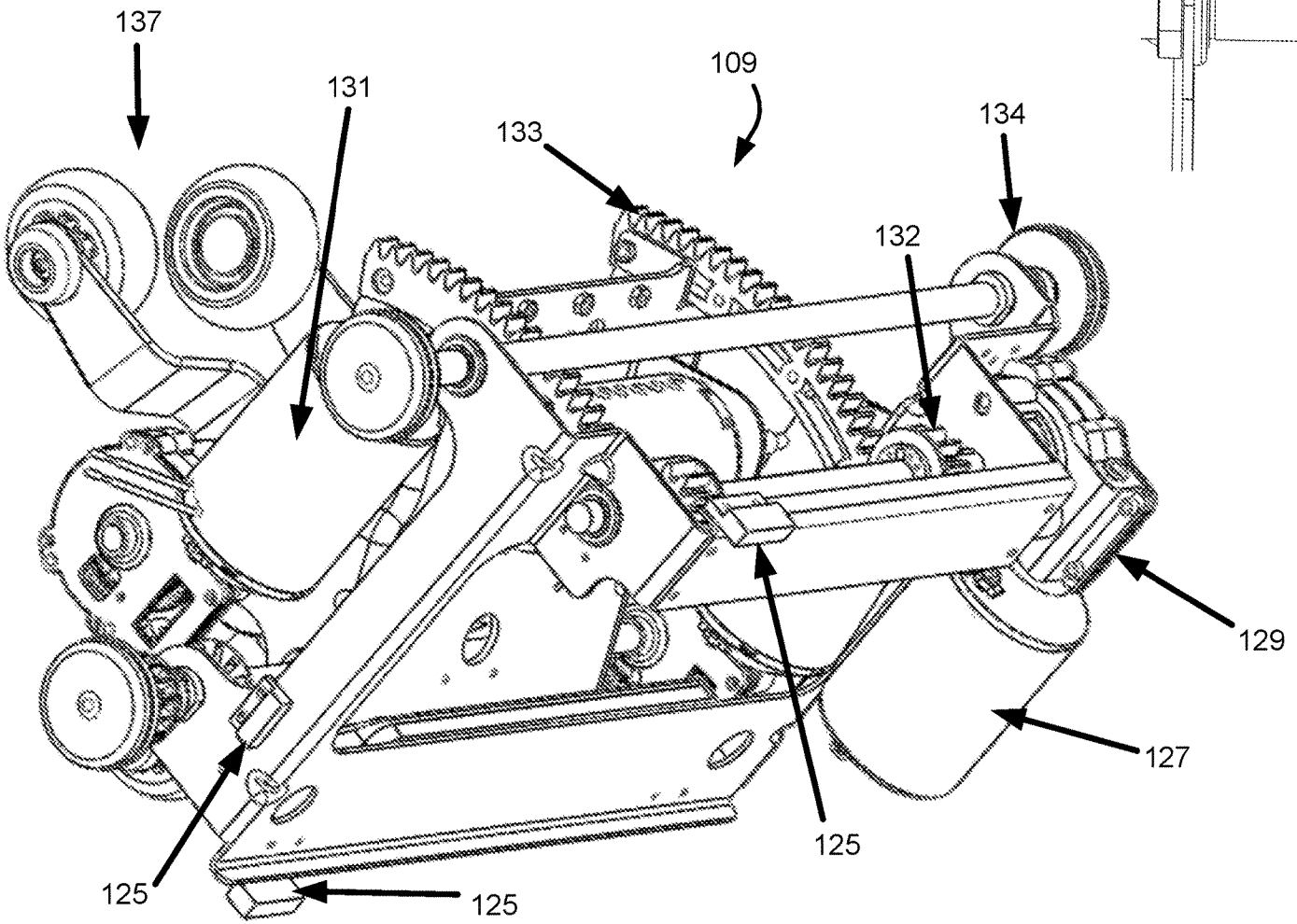
FIG. 12 is a rear perspective view of the roller mechanism of FIG. 11.

Referring now also to FIG. 12 in the drawings, a rear perspective view of roller mechanism 109 is illustrated. Roller mechanism 109 includes a sensor 125, a driving motor 127, and gearbox 129, and a roller motor 131. In this view, sensors 125 are more visible. Sensors 125 can be a contact or non-contact type. Sensors 125 communicates with the controller and is configured to monitor the position of mechanism 109 relative to frame 103 and other objects or mechanisms that may be in its path. When sensor 125 is triggered, mechanism position driving motor 127 stops or reverses direction.

Driving motor 127 is used to operate a massage intensity control function. Motor 127 acts to move a gear 132 along a gear track 133 to alter the position of a roller drive assembly 137. Motor 127 rotates assembly 137 about a lower shaft that also provides rotating axis for wheels 134 and gears in FIG. 14. Assembly 137 includes rollers 135 which are selectively used to apply pressure on a user. Gearbox 129 is operated in conjunction with driving motor 127 to assist in altering the pitch or tilt of assembly 137 along a gear track 133. This helps to locate rollers 135 on mechanism 109 to be moved into and out of contact with the user, thereby adjusting the intensity of rollers 135 on the user. A roller motor 131 is used to activate and position the rollers 135 and is part of assembly 137. Generally, motor 131 will operate most of the time during a massage cycle. The lifetime of the whole system is limited by the lifetime of this motor 131. To increase the system reliability and lifetime, a motor technology with longer lifetime is preferred. In this invention, a brushless motor type is selected for this purpose. Together, roller motor 131 and track 133 may be used to apply optimal pressure to the user.

Figure 13:
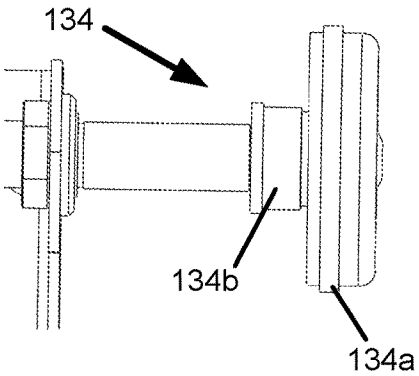
FIG. 13 is an enlarged view of a support wheel on the roller mechanism of FIG. 12.

Referring now also to FIG. 13 in the drawings, a front view of support wheel 134 is illustrated. A plurality of support wheels 134 are located around the perimeter of mechanism 109. At least one wheel includes a gear which is used to travel along a track (not shown) thereby permitting movement along frame 103. Each wheel comprises a plastic circular body wheel and a rubber band 134*a* which surrounds a portion of the wheel body. The outer diameter of the rubber band is slightly greater than diameter of the wheel to provide gap control and prevent shaking during movement and reduce mechanical noise. This feature helps to compensate for manufacturing tolerances and ensure a smooth ride within frame 103. Additionally, a rubber bushing 134*b* may be used to also compensate for tolerances.

Figure 14:
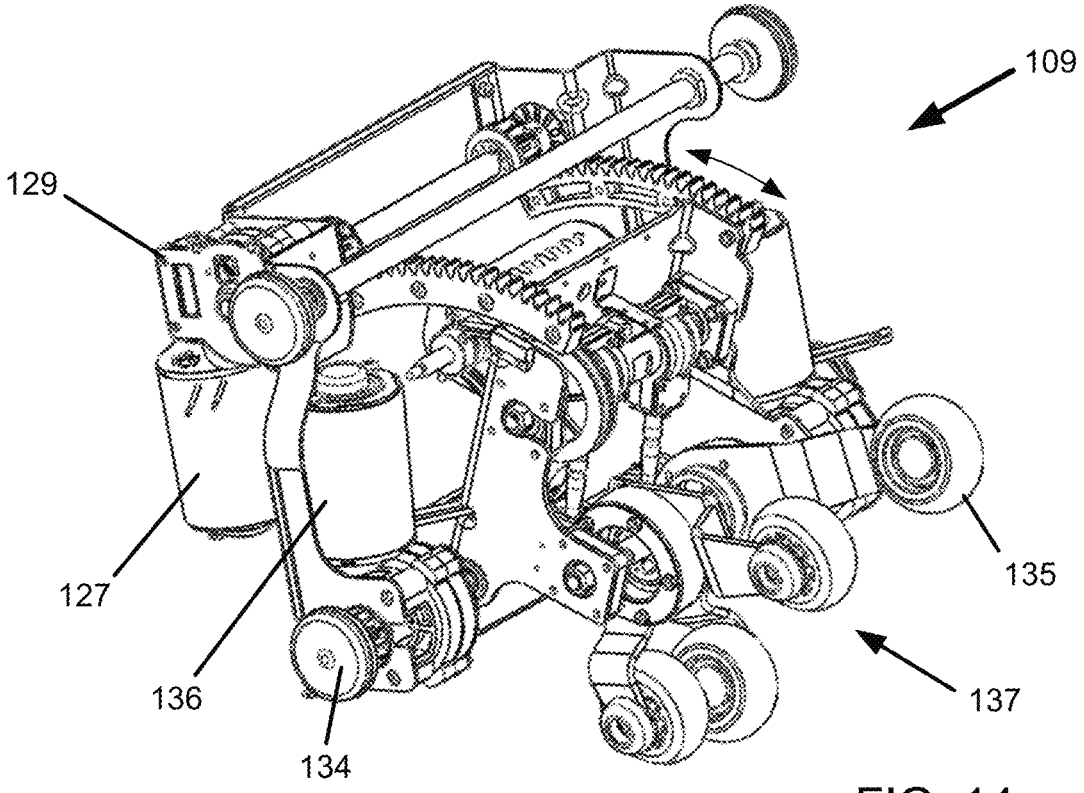
FIGS. 14 and 15 are additional perspective views of the roller mechanism of FIG. 12.
Figure 15:
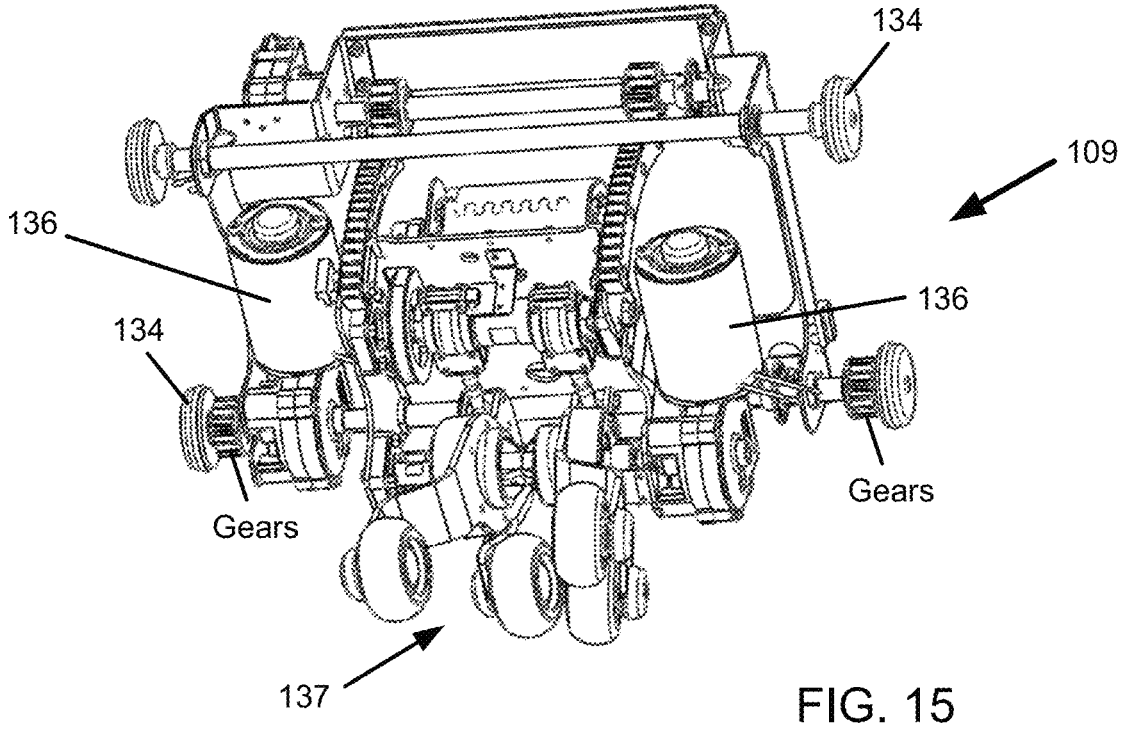

Referring now also to FIGS. 14 and 15 in the drawings, additional perspective views of roller mechanism 109 are illustrated. In FIG. 14, a front perspective view is shown providing a glimpse of an opposing side as that in FIG. 12. A position drive motor 136 is shown. Motor 136 is configured to drive mechanism 109 along frame 103 through wheels 134. The gears of wheel 134 engage corresponding tracks in the backrest 104 rails. One or more motors 136 may be used.

Figure 16:
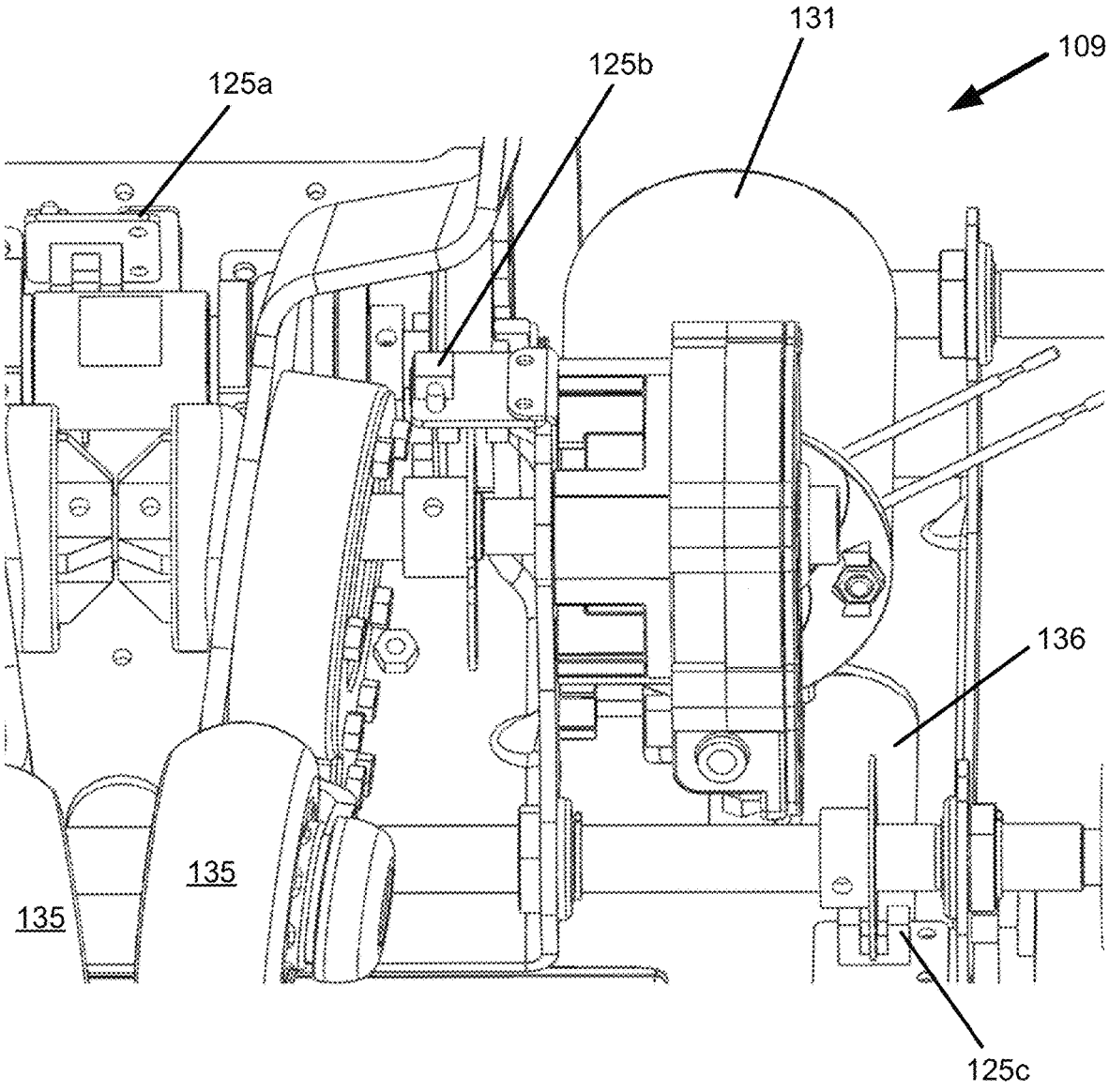
FIG. 16 is an enlarged partial front view of the roller mechanism in FIG. 12.

Referring now to FIG. 16 in the drawings, a partially enlarged view of roller mechanism 109 is illustrated. Chair 101 includes a sensor suite used to monitor and track the position, speed, angle, orientation and so forth of any one of the many moving parts therein. Sensor 125 was previously described. Mechanism 109 further includes sensor 125*a* as a shaft position sensor configured to track the position of the shaft for rollers 135 in order to align rollers 135 to the same height level and for balancing the rollers 135. Sensor 125*b* is used to monitor and detect the roller width control. This is used to track the maximum and minimum width of rollers 135. Sensor 125*c* is a position sensor to track the angular position along track 133.

Figure 17:
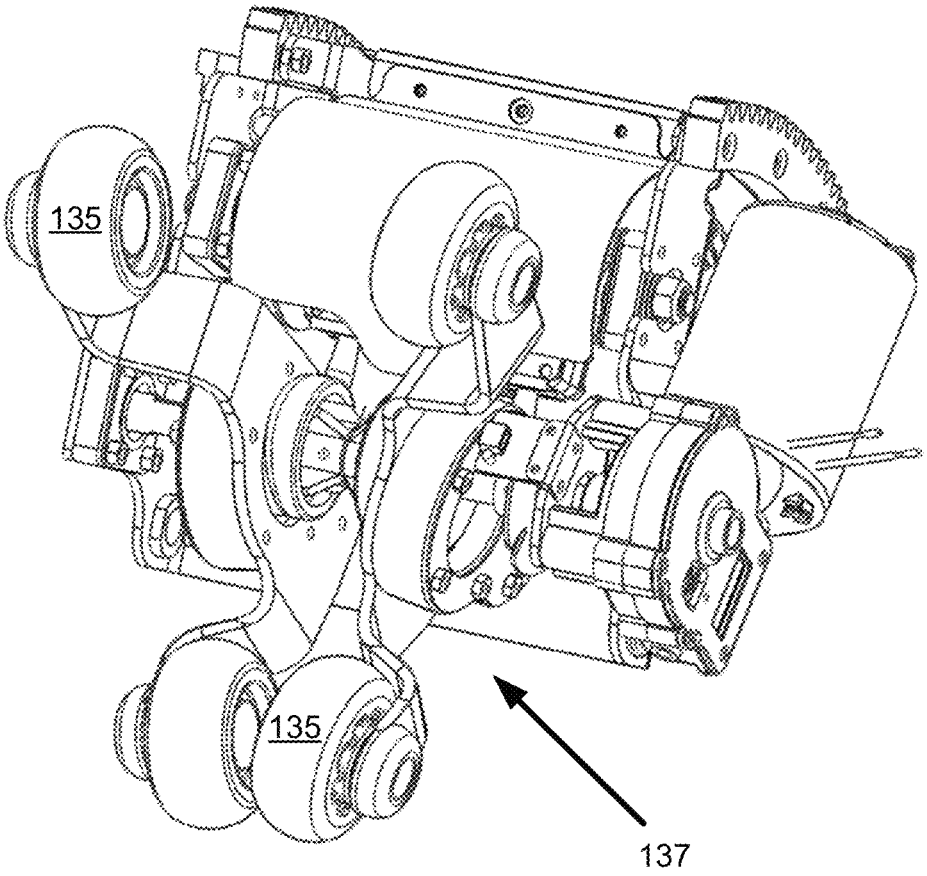
FIG. 17 is a front perspective view of a roller drive assembly in the roller mechanism of FIG. 12.

Referring now also to FIG. 17 in the drawings a front perspective view of roller drive assembly 137 is illustrated. Some portions of mechanism 109 are also left in the view for contextual purposes.

Figure 18:
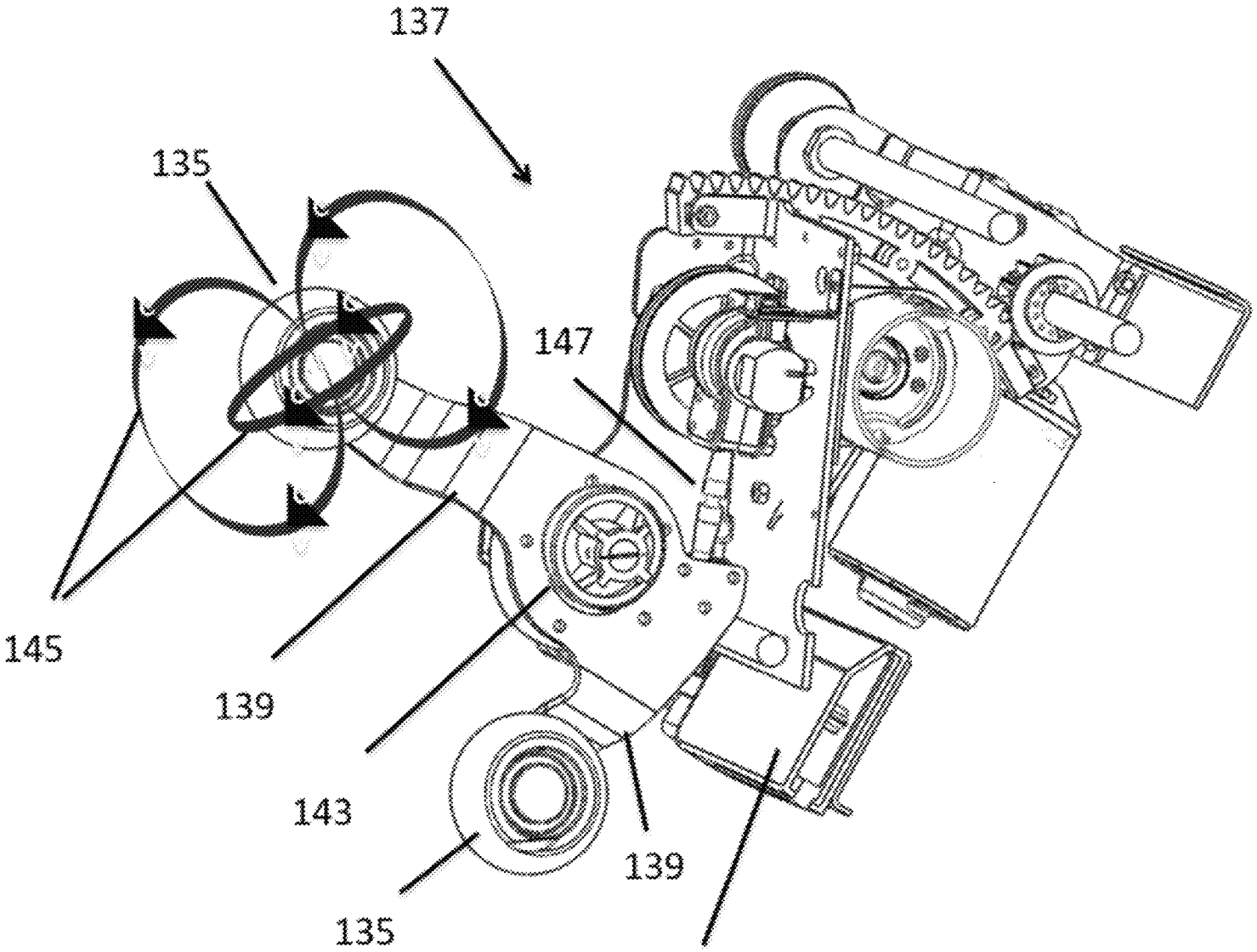
FIG. 18 is a section view of the roller drive assembly of FIG. 17.

Referring now also to FIG. 18 in the drawings, a section view of roller drive assembly 137 is shown as seen from FIG. 17. Rollers 135 are coupled to arm 139. Rollers 135 are configured to freely spin about an axis at one end of arm 139. Each roller 135 is coupled to an arm, but each arm may have different lengths and contours to assist in covering more area on the user when moving. Arm 139 is configured to rotate about an axis. Arm 139 is coupled to a roller motion drive element 143. A shaft engages an end of element 143 at a non-perpendicular angle relative to arm 139 such that rotation of arm about the shaft induces a three-dimensional orbital motion 145 in rollers 135. The motions 145 can be generated in many different forms by controlling the motor 136 with forward and reverse control, on time and off time control, speed control, pulsating control, and any combinations of these controls. As a result, multiple different roller motions or massage effects can be induced to the user.

A ball joint 147 attaches to a distal end of arm 139. Joint 147 is a member having a ball at opposing ends with a rod therebetween. One ball is coupled to arm 139 and the other end is coupled to a portion of mechanism 109. The ball of joint 147 engaged with arm 139 sits within a socket (not shown) to allow rotational movement.

Roller assembly 137 also includes a controller 141 with a processor and software. The controller 141 is configured to interface with the motors and sensors of mechanism 109 for accurate massage control and to eliminate electro-magnetic noise interferences.

Figure 19:
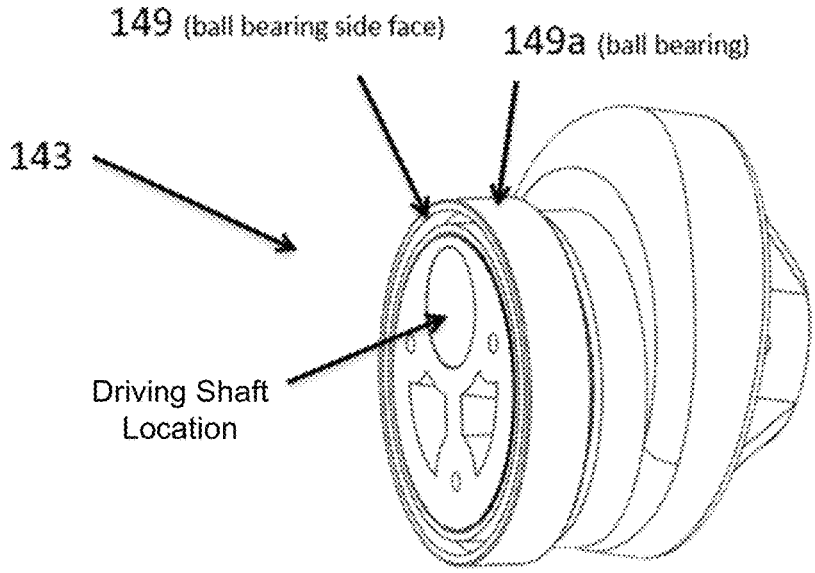
FIGS. 19-21 are views of a roller motion drive element in the roller motion drive assembly of FIG. 17.
Figure 20:
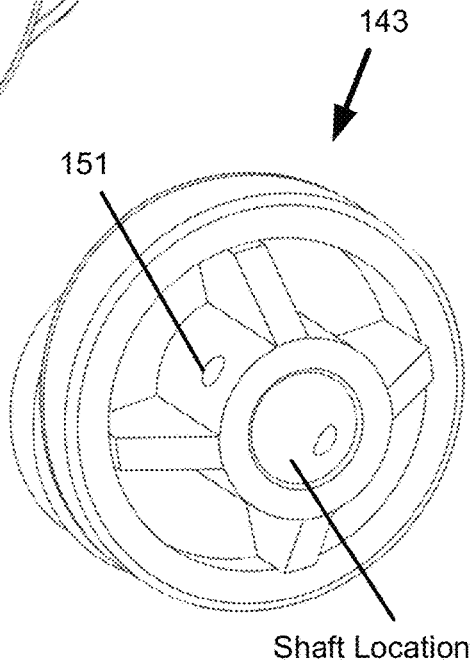
Figure 21:
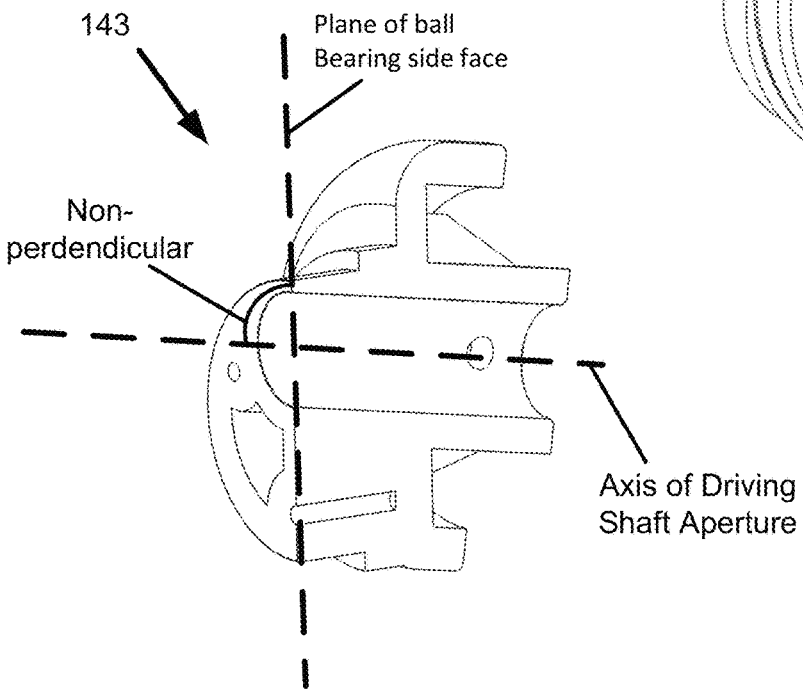

Referring now also to FIGS. 19-21 in the drawings, assorted views of roller motion drive element 143 are illustrated. A driving ball bearing 149*a* is mounted to roller driver element 143. Arm 139 is structurally attached to the ball bearing. Arm 139 is parallel to the side face 149 of the ball bearing 149*a*. The material of arm 139 is preferred to be metal. The driving shaft location in FIG. 19 is non-centrally aligned compared to the location in FIG. 20. In FIG. 21 the axis of the shaft aperture is shown as it passes through element 143. The driving shaft passes through the ball bearing at a point that is offset from ball bearing's center point. The plane of the driving ball bearing side face is non-perpendicular to the axis of the driving shaft. Therefore, as the driving shaft rotates, the arm will "wobble" in a nonplanar three-dimensional motions. The angle between ball bearing side face and driving shaft axis can vary upon design restraints. An example of a suitable angle could be that of an angle less than 85 degrees for a range of common user's body sizes. A lock mechanism 151 may be included to secure or lock the element 143 to the driving shaft. This design generates a three-dimensional motion of the roller 135 by a single driving motor. The motor can be controlled in many ways with forward and reverse control, on time and off time control, speed control, pulsating control, and any combinations of these controls. As a result, multiple different massage effects can be induced to the user.

Figure 22:
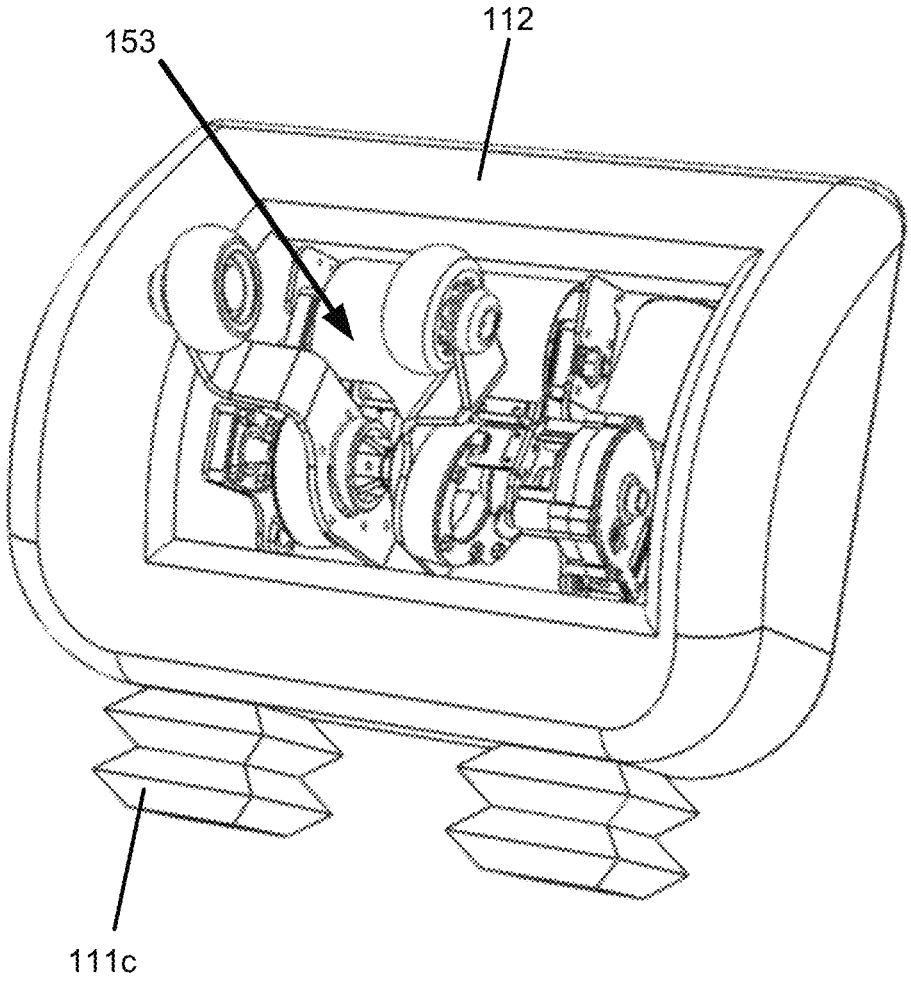
FIG. 22 is a front perspective view of a neck roller mechanism in a headrest of the massage chair of FIG. 1.
Figure 23:
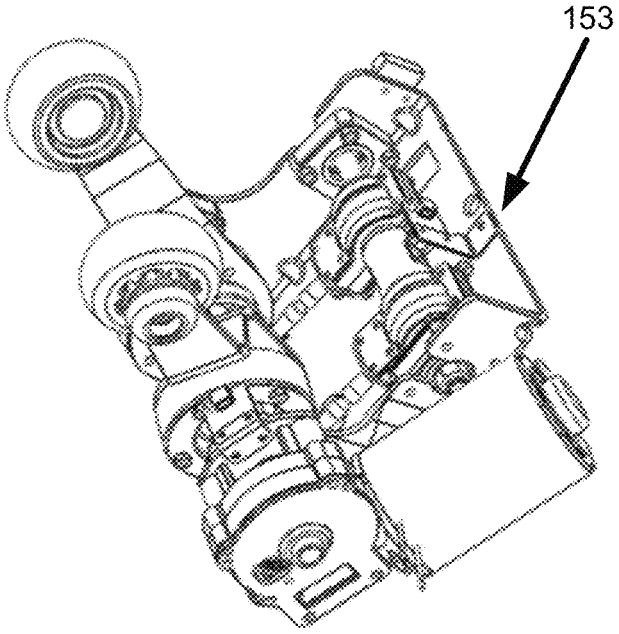
FIGS. 23 and 24 are views of the neck roller mechanism of FIG. 22.
Figure 24:
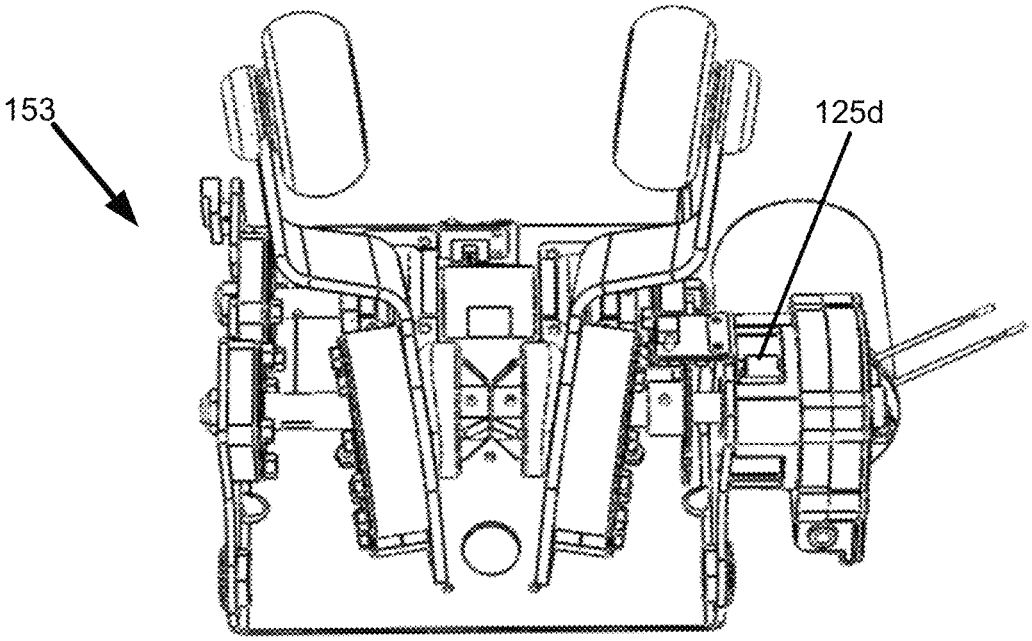

Referring now also to FIGS. 22-24 in the drawings, views of a neck roller mechanism 153 in headrest 112 is shown. Headrest 112 is shown with a portion removed in an effort to show mechanism 153. Headrest 112 is a foam based pillow used to support the head and/or neck of a user. Mechanism 153 is similar in form and function to that of mechanism 109 except that mechanism 153 does not tend to have intensity control motor or mechanism position movement. Also, the mechanism 153 comprises only one pair of rollers instead of two pairs as shown in mechanism 109. This single pair of rollers can reach further to the neck area of user and provide a better and wider massage surface coverage. The rollers move in the three-dimensional motion similar to mechanism 109.

As seen, mechanism 153 includes a roller coupled to a movable arm. Also included are a plurality of airbags 111*c* coupled to a lower portion of headrest 112. When inflated, airbags 111*c* compress against the shoulders and neck area of a user. Airbags 111*c* are similar in form and function to that of airbags 111. A sensor 125*d* monitors the maximum and minimum width of the rollers. When a massage cycle is complete the roller are parked at a max width position so the user can rest comfortably against headrest 112.

Figure 25:
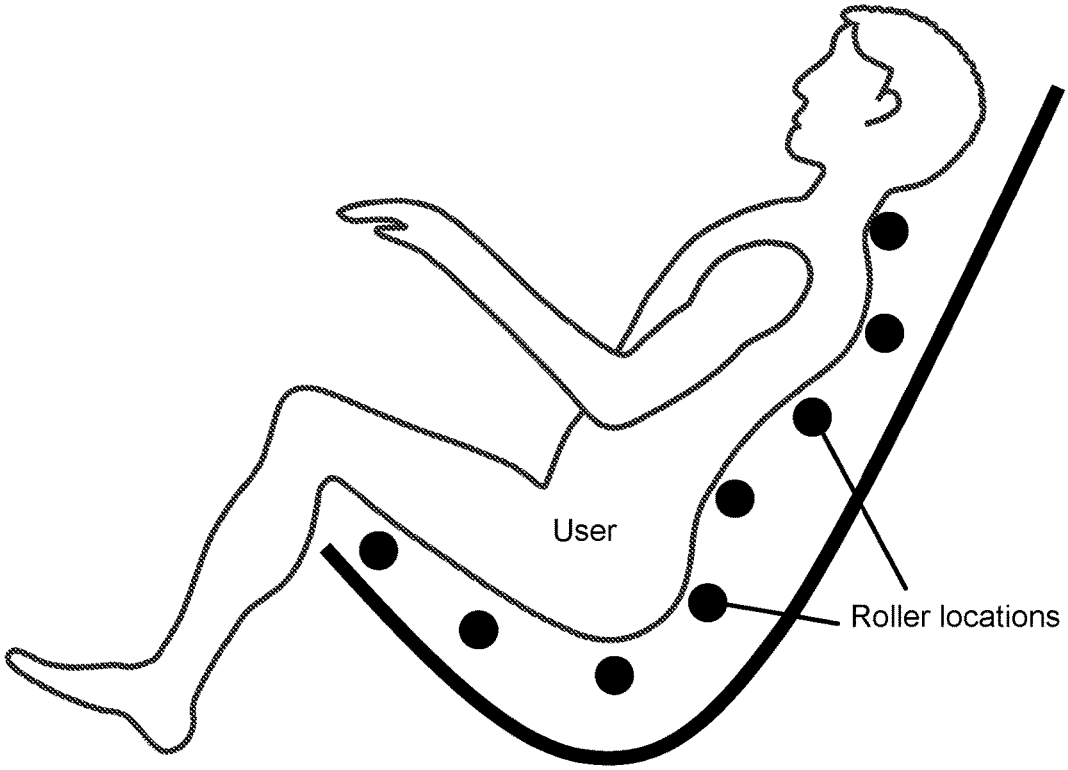
FIG. 25 is a chart showing a body detection system in the massage chair of FIG. 1.
Figure 26:
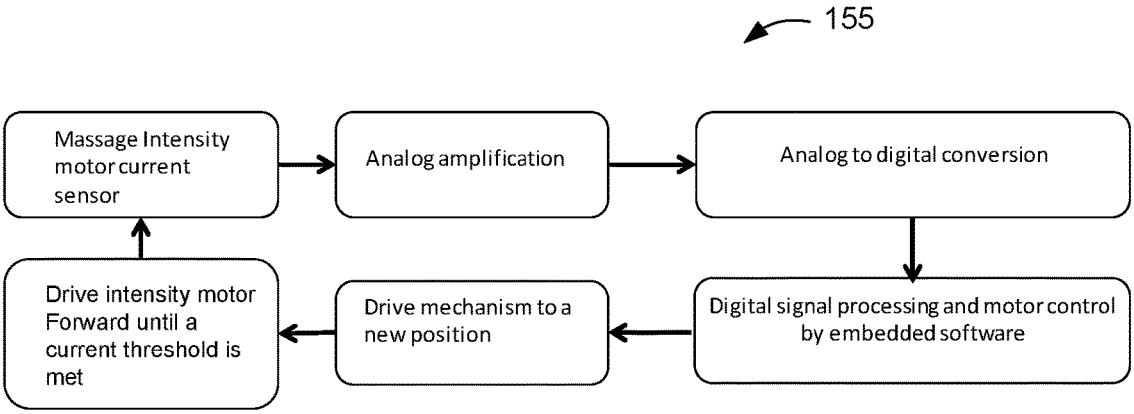
FIG. 26 is a flow chart of the body detection system of FIG. 25.

Referring now also to FIGS. 25 and 26 in the drawings, charts showing a body shape detection system 155 in chair 101 is illustrated. System 155 is configured to utilize mechanism 109 to detect at least one of the size and shape of the user in the chair 101. Utilizing any of the sensors and motors, the level or amount of load exerted back on the rollers can be determined.

An exemplary manner in which system 155 may detect the size and/or shape of the user is as follows: An electronic control board or controller 141 is used to drive mechanism 109 along the body of the user. This may be from the lower back to the head for example. The massage rollers 135 are set to a max width. The rollers will poke on the user's back as mechanism 109 traverses along frame 103. Along the way, mechanism 109 will push the rollers forward and backward by driving the intensity control motor 127. During this process, the current of the intensity motor 127 is recorded along with the correlated distance at which rollers 135 move out from a base line. The distance is detected by a revolution counting sensor or by counting time elapsed. When the rollers pass the shoulder level, the rollers will experience a "no" or "light" load situation and the shoulder position is detected by this condition, the condition where the load substantially decreases. The recorded data is used to compute a body shape, and locate the shoulder, neck, lower back, mid back, and upper back positions of the user. This data is used by the chair software to adjust the massage routine or profile and to provide a massage profile that is best fit for the user sitting in the chair. The number of pokes by rollers 135 determine the resolution of the body scan. The higher number of pokes results a higher detection accuracy. The body detection data is displayed on a keypad or remote screen. FIG. 26 illustrates the steps in analysis by controller 141 and/or any other circuit board with processor.

Figure 27:
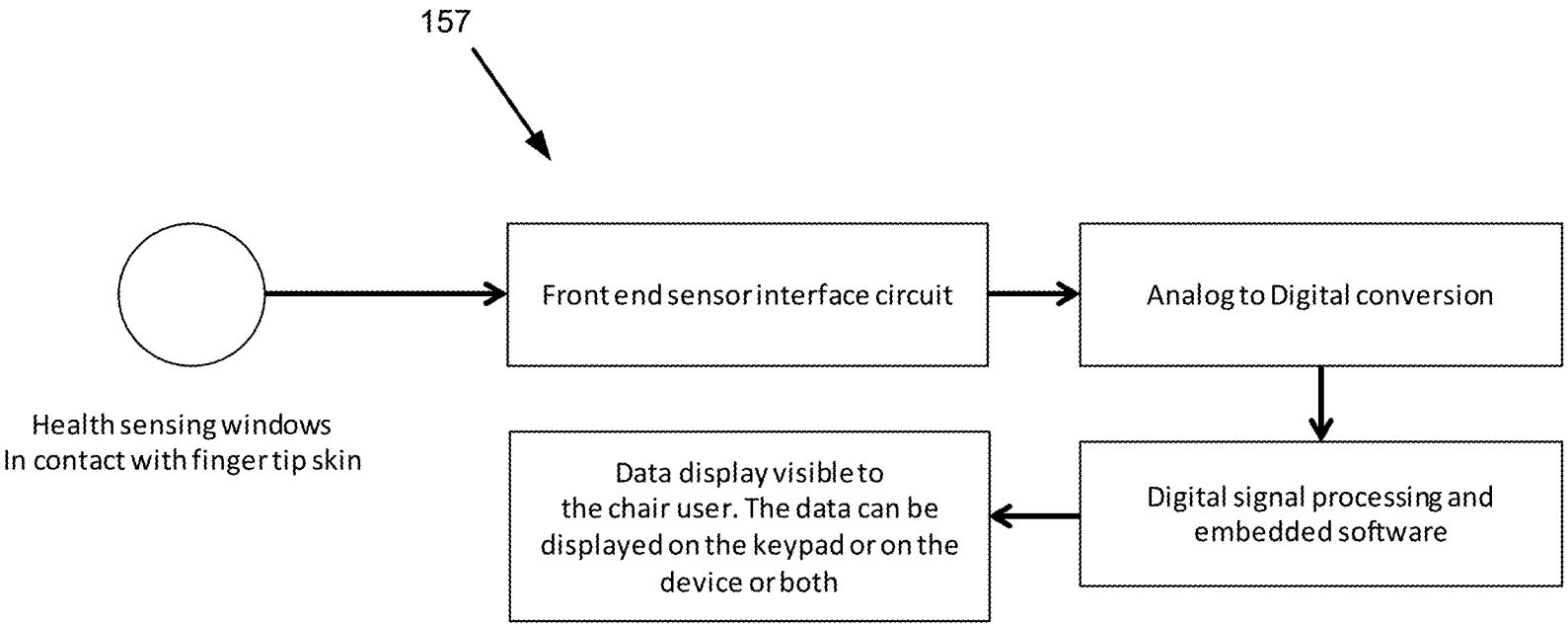
FIG. 27 is a chart of a medical assessment device in the massage chair of FIG. 1.

Referring now back to FIG. 1 and to FIG. 27 in the drawings, a chart for a medical assessment device 157 is illustrated. Device 157 is coupled to an outer surface of chair 101, such as on arm rest 110 (see FIG. 1). Device 157 is configured to include a sensor that is capable of measuring one or more bodily characteristics. Examples of bodily characteristics may refer to blood pressure, heart rate, body temperature, blood sugar, and oxygen level for example. A window or sensor pad may be used. Mere contact with a portion of the users body may provide sufficient surface to provide the measurement. It is preferred that touch only is necessary, however, other types of measurements may be necessary that pierce the skin. These are avoided at all cost if possible. This information is processed by a computerized processor for analysis. The user's health data is visible to the chair user. The data can be displayed on a keypad or on a device or remote.

Figure 28:
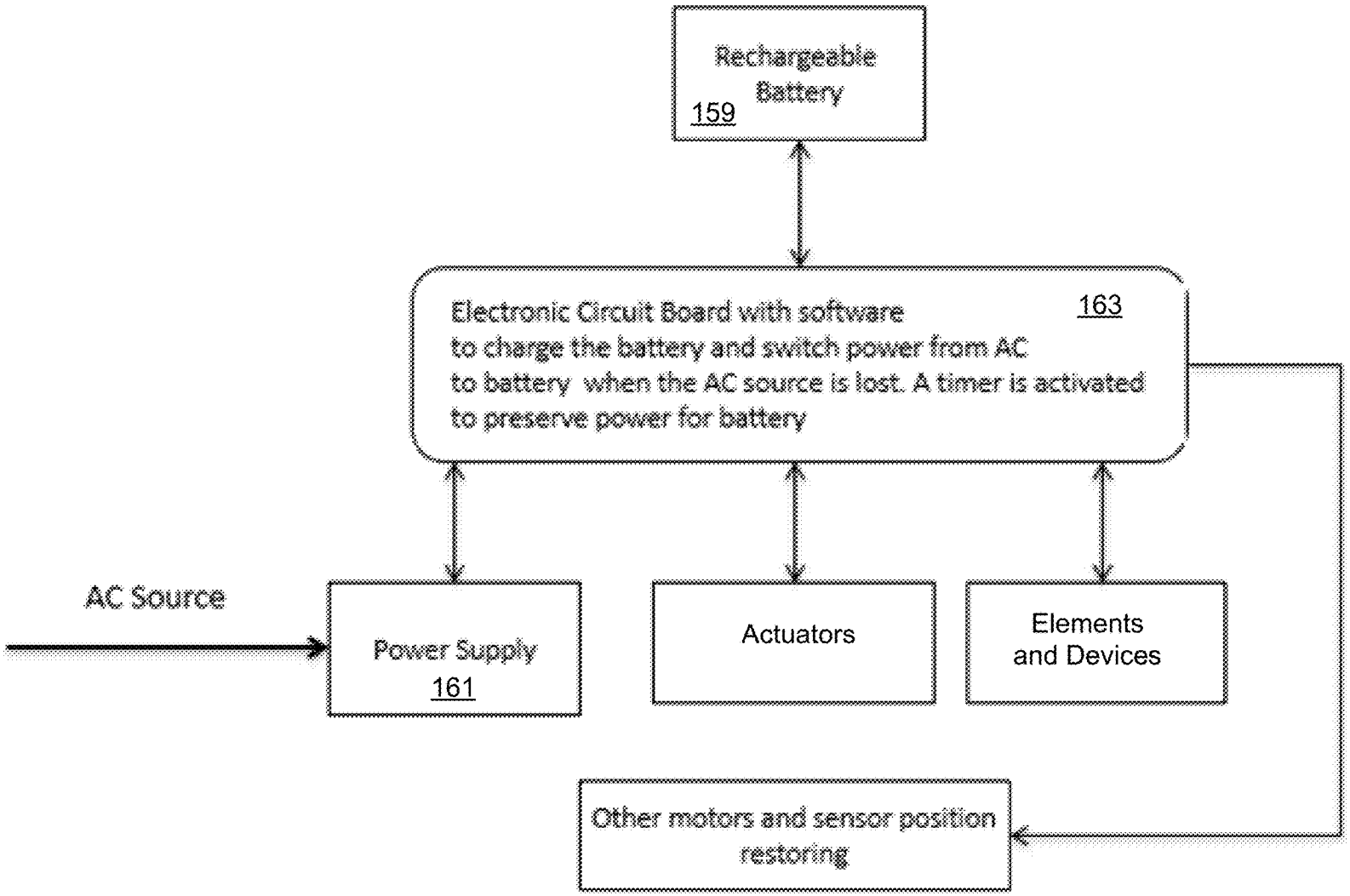
FIG. 28 is a chart of the electrical communication of components in the massage chair of FIG. 1.

Referring now also to FIG. 28 in the drawings, a chart for massage chair 101 is illustrated. Chair 101 is operable with both an AC power source provided through the power grid and a rechargeable battery 159. Power supply 161 provides power to board 163, actuators, elements and devices, and other motors and sensor position restoring components. Such components may include any and all of the massagers previously disclosed and other actuators, roller, and motors used with chair 101. Battery 159 is configured to receive charging from the AC power source and selectively supplement power to chair 101. An example of a situation where this may occur is during a power outage. This is advantageous as current massage chairs are not equipped with a backup power source. Users with medical conditions and those that are advanced in age find it extremely difficult to exit conventional massage chairs if power is lost and the chair is not in the upright position, the upright position being when the frame 103 is upright. Battery 159 is a built-in rechargeable battery that automatically activates upon a power loss to permit chair 101 to restore the upright position. Once the upright position is restored, the chair 101 may be placed in a lower power mode to conserve energy.

It is understood that chair 101 may be used in various different ways apart from those illustrated and disclosed herein while being within the scope and intent of the embodiments. Use may include a massage chair to provide massage effects to at least a user's body, feet, legs, and back areas. The massage chair uses a software algorithm with board 163 to control the procedures and operations of the chair 101. These may include inflating the airbags 111 to hold and squeeze the user's body or manipulate its movement.

It is understood that one or more computers or electronic devices may be associated and included within chair 101. Among these are electronic circuit boards that may include embedded software program for monitoring the performance of the back massage system and the thigh massage system, or any other system, device, sensor or component of chair 101. The computers and electronic circuit board are configured to transmit and receive data from one or more remote devices through wired or wireless methods. This data transmission is useful for trouble shooting and the service of the massage chair 101.

Figure 29:
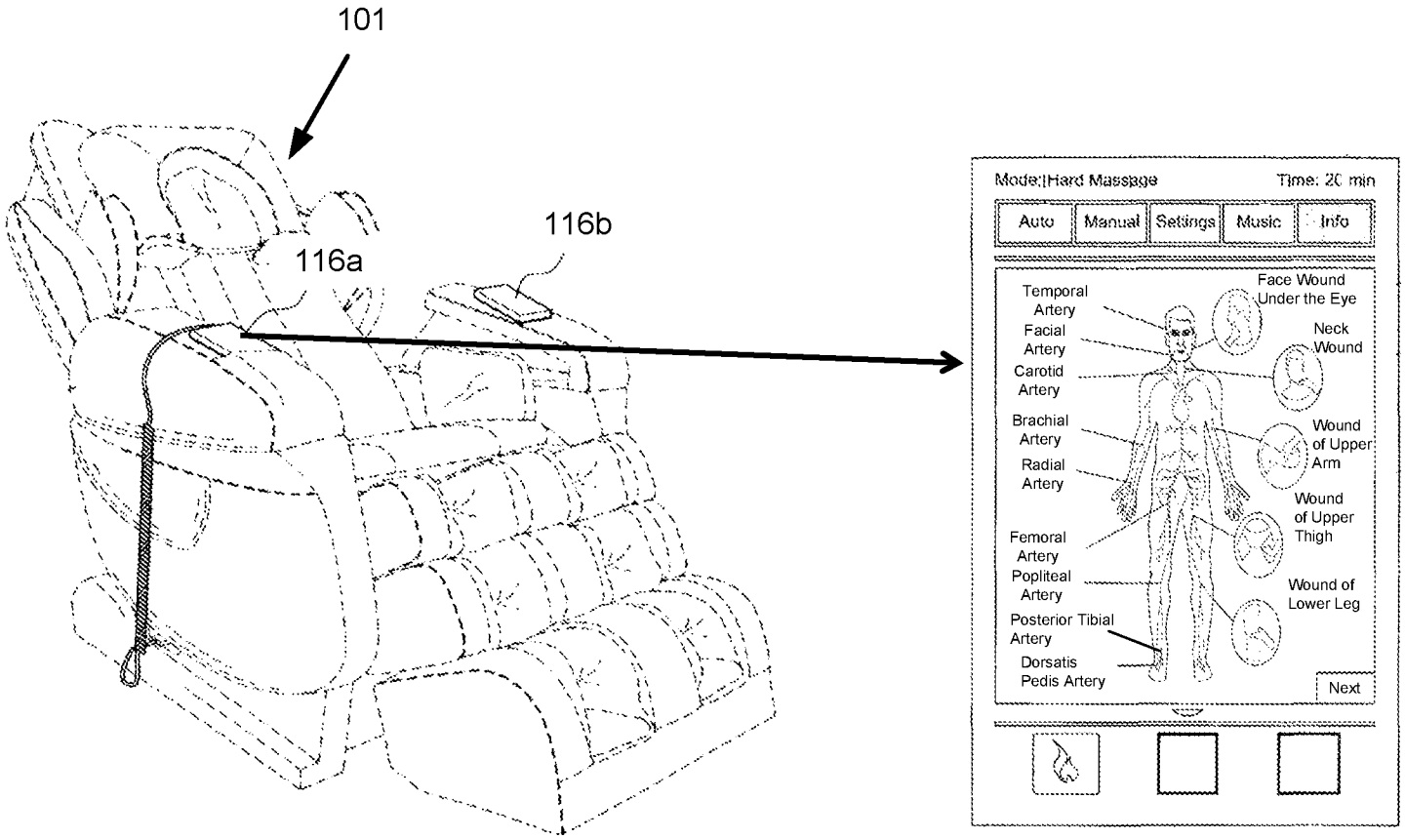
FIG. 29 is a front view of a touchscreen device of a touchscreen-based control system in the massage chair of FIG. 1.

Referring now also to FIG. 29 in the drawings, a control device 116*a*/116*b* is optionally included with chair 101. Chair 101 is controlled by a smart touchscreen keypad system that allows the user to control the chair with a touch by finger tips. The smart touchscreen keypad system also displays useful Information such as health, system failure diagnostics, and all data can be sent to the manufacture's server via internet. This is useful data for the manufacture to troubleshoot the chair for field support and service. Examples of the control device may be a wired control device 116*a*. Another example of the control device is a personal electronic device having software applications that are configured to sync with the systems of chair 101. A camera is also optionally included that is used with facial recognition software, either programmed into the chair or via the software application, to scan and capture the identity of the user in the chair. Prior users will be recognized and the system of the chair will load personal profiles of the user, treatment data, or any other saved information for the user.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A method for scanning a user's body in a massage chair using a roller mechanism and an electronic system, method comprising:

driving a roller mechanism along the user's body;

poking on a user's back with a roller as the roller mechanism is moving;

wherein, poking is generated by driving an intensity control motor to cause the roller to move forward and backward;

during a poke, the electronic system records load current of the intensity control motor and distance that the roller traveled;

processing the recorded motor load current data to generate a body shape curve or locate a position of a user's body part, including a shoulder, or neck, or lower back, or mid back, or upper back positions of the user's body;

wherein, the roller mechanism includes a roller motion drive element to hold or support a driving ball bearing, the roller motion drive element having an aperture for a driving shaft to pass through; and wherein, said driving shaft configured to pass through the roller motion drive element in an offset non-perpendicular angle relative to a driving ball bearing side face.

2. The method of claim 1, wherein the roller is driven by the intensity control motor and the roller is configured to move in a three dimensional motion.

3. The method of claim 1, the roller mechanism including an arm coupled to a roller motion drive element.

4. The method of claim 1, the roller mechanism including a brushless motor.

5. The method of claim 1, the roller mechanism including a ball joint coupled to an arm at a roller motion drive element, whereas, the ball joint and the arm material is metal for improving the product lifetime.

6. The method of claim 1, further comprising:

an actuator wherein the length of said actuator is configured to be adjusted and locked.

7. The method of claim 1, the electronic system including an electronic circuit board having an embedded software program and electronics for driving a motor and a motor current sensing.

8. The method of claim 1, the electronic system including an electronic circuit board having an embedded software program for locating the roller mechanism position in the chair.

9. The method of claim 8, the embedded software includes a loop program that reads motor load current data and drives the roller mechanism to a new position.

10. The method of claim 1, wherein poking pressure is controlled by an electronic circuit board with embedded software.

11. A method for scanning a user's body in a massage chair using a roller mechanism and an electronic system, method comprising:

driving a roller mechanism along the user's body;

poking on a user's back with a roller as the roller mechanism is moving; wherein, poking is generated by driving an intensity control motor to cause the roller to move forward and backward;

during a poke, the electronic system records load current of the intensity control motor and distance that the roller traveled, and compares the recorded motor load current to a threshold; and processing the recorded motor load current data to generate a body shape curve or locate a position of a user's body part, including a shoulder, or neck, or lower back, or mid back, or upper back positions of the user's body;

wherein, the roller mechanism includes a roller motion drive element to hold or support a driving ball bearing, the roller motion drive element having an aperture for a driving shaft to pass through; and wherein, said driving shaft configured to pass through the roller motion drive element in an offset non-perpendicular angle relative to a driving ball bearing side face.

12. The method of claim 11, wherein the roller is driven by the intensity control motor and the roller is configured to move in a three dimensional motion.

13. The method of claim 11, wherein the roller mechanism includes an arm coupled to the roller motion drive element.

14. The method of claim 11, wherein the roller mechanism includes a brushless motor.

15. The method of claim 11, wherein the roller mechanism includes a ball joint coupled to an arm at the roller motion drive element, whereas, the ball joint and arm material is metal for improving the product lifetime.

16. The method of claim 11, further comprising:

an actuator wherein the length of said actuator is configured to be adjusted and locked.

17. The method of claim 11, wherein the electronic system includes an electronic circuit board having an embedded software program and electronics for driving a motor and a motor current sensing.

18. The method of claim 11, wherein the electronic system includes an electronic circuit board having an embedded software program for locating the roller mechanism position in the chair.

19. The method of claim 18, wherein the embedded software includes a loop program that reads motor load current data and drives the roller mechanism to a new position.

20. The method of claim 11, wherein a poking pressure is controlled by an electronic circuit board with embedded software.

21. A method for scanning a user's body in a massage chair using a roller mechanism and an electronic system, method comprising:

driving a roller mechanism along the user's body;

poking on a user's back with a roller as the mechanism is moving; wherein, poking is generated by driving an intensity control motor to cause the roller to move forward and backward;

during a poke, the electronic system records load current of the intensity control motor and distance that the roller traveled, and compares the recorded motor load current to a threshold; and processing the recorded motor load current data to generate a body shape curve or locate a position of a user's body part, including a shoulder, or neck, or lower back, or mid back, or upper back positions of the user;

wherein, the electronic system includes a motor current sensor, and an analog to digital conversion, a motor control, and a digital signal processor with embedded software;

wherein, the roller mechanism includes a roller motion drive element to hold or support a driving ball bearing, the roller motion drive element having an aperture for a driving shaft to pass through; and wherein, said driving shaft configured to pass through the roller motion drive element in an offset non-perpendicular angle relative to a driving ball bearing side face.

22. The method of claim 21, wherein the roller is driven by the intensity control motor and the roller is configured to move in a three dimensional motion.

23. The method of claim 21, wherein the roller mechanism includes an arm coupled to the roller motion drive element.

24. The method of claim 21, wherein the roller mechanism includes a brushless motor.

25. The method of claim 21, wherein the roller mechanism includes a ball joint coupled to an arm at the roller motion drive element, whereas, the ball joint and arm material is metal for improving the product lifetime.

26. The method of claim 21, further comprising:

an actuator wherein the length of said actuator is configured to be adjusted and locked.

27. The method of claim 21, wherein the electronic system includes an electronic circuit board having an embedded software program and electronics for driving a motor and a motor current sensing.

28. The method of claim 27, wherein the electronic system includes an electronic circuit board having an embedded software program for locating the roller mechanism position in the chair.

29. The method of claim 21, further comprising:

adjusting a massage routine or profile of the user in accordance with a detected body size of the user.

30. The method of claim 21, further comprising:

selecting a detection accuracy for the body scan by selecting the quantity of poking actions with the roller.

* * * * *